US009607734B2

(12) United States Patent
Gundel

(10) Patent No.: US 9,607,734 B2
(45) Date of Patent: Mar. 28, 2017

(54) SHIELDED ELECTRICAL RIBBON CABLE WITH DIELECTRIC SPACING

(71) Applicant: 3M INNOVATIVE PROPERTIES COMPANY, St. Paul, MN (US)

(72) Inventor: Douglas B. Gundel, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/711,813

(22) Filed: May 14, 2015

(65) Prior Publication Data

US 2015/0255191 A1 Sep. 10, 2015

Related U.S. Application Data

(63) Continuation of application No. 13/921,253, filed on Jun. 19, 2013, now Pat. No. 9,064,612, which is a continuation of application No. 13/540,648, filed on Jul. 3, 2012, now Pat. No. 8,492,655, which is a continuation of application No. PCT/US2010/060623, filed on Dec. 16, 2010.

(60) Provisional application No. 61/378,868, filed on Aug. 31, 2010.

(51) Int. Cl.

| | |
|---|---|
| ***H01B 7/08*** | (2006.01) |
| ***H01B 11/00*** | (2006.01) |
| ***H01B 11/20*** | (2006.01) |
| ***H01B 9/02*** | (2006.01) |

(52) U.S. Cl.

CPC ..... *H01B 7/0861* (2013.01); *H01B 7/0838* (2013.01); *H01B 9/02* (2013.01); *H01B 11/002* (2013.01); *H01B 11/203* (2013.01)

(58) Field of Classification Search

CPC ..... H01B 7/08
USPC ..... 174/117 F
See application file for complete search history.

(56) References Cited

U.S. PATENT DOCUMENTS 2,927,952 A 3/1960 Wermine
3,013,109 A 12/1961 Gorman et al.
(Continued)

FOREIGN PATENT DOCUMENTS

DE 911277 9/1954
DE 2644252 9/1976
(Continued)

OTHER PUBLICATIONS

PCT International Search Report for PCT/US2010/060623 mailed Jun. 17, 2011, 4 pages.

*Primary Examiner* — Chau N Nguyen
(74) *Attorney, Agent, or Firm* — Robert S. Moshrefzadeh

(57) ABSTRACT

An electrical ribbon cable includes at least one conductor set having at least two elongated conductors extending from end-to-end of the cable. Each of the conductors are encompassed along a length of the cable by respective first dielectrics. A first and second film extend from end-to-end of the cable and are disposed on opposite sides of the cable The conductors are fixably coupled to the first and second films such that a consistent spacing is maintained between the first dielectrics of the conductors of each conductor set along the length of the cable. A second dielectric disposed within the spacing between the first dielectrics of the wires of each conductor set.

8 Claims, 20 Drawing Sheets

(56) References Cited

U.S. PATENT DOCUMENTS

| | | | | |
|---|---|---|---|---|
| 3,219,752 | A * | 11/1965 | Harris | H01B 7/0233 174/117 R |
| 3,496,281 | A | 2/1970 | McMahon | |
| 3,775,552 | A | 11/1973 | Schumacher | |
| 3,798,346 | A | 3/1974 | Kreuzer | |
| 3,993,394 | A | 11/1976 | Cooper | |
| 4,099,323 | A | 7/1978 | Bouvier | |
| 4,149,026 | A | 4/1979 | Fritz et al. | |
| 4,185,162 | A | 1/1980 | Bogese | |
| 4,287,385 | A | 9/1981 | Dombrowsky | |
| 4,297,522 | A | 10/1981 | Jesse et al. | |
| 4,382,236 | A | 5/1983 | Suzuki | |
| 4,404,424 | A | 9/1983 | King et al. | |
| 4,412,092 | A | 10/1983 | Hansell, III | |
| 4,413,469 | A | 11/1983 | Paquin | |
| 4,449,778 | A | 5/1984 | Lane | |
| 4,468,089 | A | 8/1984 | Brorein | |
| 4,470,195 | A | 9/1984 | Lang | |
| 4,475,006 | A | 10/1984 | Olyphant | |
| 4,481,379 | A | 11/1984 | Bolick et al. | |
| 4,487,992 | A | 12/1984 | Tomita | |
| 4,490,574 | A | 12/1984 | Tomita et al. | |
| 4,492,815 | A | 1/1985 | Maros | |
| 4,611,656 | A | 9/1986 | Kendall, Jr. et al. | |
| 4,705,332 | A | 11/1987 | Sadigh-Behzadi | |
| 4,720,155 | A | 1/1988 | Schildkraut et al. | |
| 4,735,583 | A | 4/1988 | Rudy, Jr. et al. | |
| 4,767,345 | A | 8/1988 | Gutter et al. | |
| 4,767,891 | A | 8/1988 | Biegon et al. | |
| 4,780,157 | A | 10/1988 | Coon | |
| 4,800,236 | A | 1/1989 | Lemke | |
| 4,850,898 | A | 7/1989 | Gallusser | |
| 4,920,234 | A | 4/1990 | Lemke | |
| 5,008,489 | A | 4/1991 | Weeks et al. | |
| 5,057,646 | A | 10/1991 | Nichols et al. | |
| 5,084,594 | A | 1/1992 | Cady et al. | |
| 5,090,911 | A | 2/1992 | Welsh | |
| 5,132,489 | A | 7/1992 | Yamano | |
| 5,162,611 | A | 11/1992 | Nichols, III et al. | |
| 5,171,161 | A | 12/1992 | Kachlic | |
| 5,184,965 | A | 2/1993 | Myschik et al. | |
| 5,235,132 | A | 8/1993 | Ainsworth et al. | |
| 5,244,415 | A | 9/1993 | Marsilio et al. | |
| 5,250,127 | A | 10/1993 | Hara | |
| 5,268,531 | A | 12/1993 | Nguyen et al. | |
| 5,279,415 | A | 1/1994 | Edgley et al. | |
| 5,286,924 | A | 2/1994 | Loder et al. | |
| 5,380,216 | A | 1/1995 | Broeksteeg et al. | |
| 5,441,424 | A | 8/1995 | Morlion et al. | |
| 5,446,239 | A | 8/1995 | Mizutani et al. | |
| 5,460,533 | A | 10/1995 | Broeksteeg et al. | |
| 5,477,159 | A | 12/1995 | Hamling | |
| 5,483,020 | A | 1/1996 | Hardie et al. | |
| 5,486,654 | A | 1/1996 | Hanak et al. | |
| 5,507,653 | A | 4/1996 | Stoner | |
| 5,511,992 | A | 4/1996 | Thalhammer | |
| 5,518,421 | A | 5/1996 | Davis | |
| 5,524,766 | A | 6/1996 | Marchek et al. | |
| 5,600,544 | A | 2/1997 | Thalhammer | |
| 5,632,634 | A | 5/1997 | Soes | |
| 5,702,258 | A | 12/1997 | Provencher et al. | |
| 5,743,765 | A | 4/1998 | Andrews et al. | |
| 5,766,036 | A | 6/1998 | Ahmad et al. | |
| 5,767,442 | A | 6/1998 | Eisenberg et al. | |
| 5,775,924 | A | 7/1998 | Miskin et al. | |
| 5,804,768 | A | 9/1998 | Sexton | |
| 5,900,588 | A | 5/1999 | Springer et al. | |
| 5,934,942 | A | 8/1999 | Patel et al. | |
| 5,938,476 | A | 8/1999 | Wu et al. | |
| 5,941,733 | A | 8/1999 | Lai | |
| 5,956,445 | A | 9/1999 | Dietz et al. | |
| 6,007,385 | A | 12/1999 | Wu | |
| 6,039,606 | A | 3/2000 | Chiou | |
| 6,089,916 | A | 7/2000 | Kuo | |
| 6,367,128 | B1 | 4/2002 | Galkiewicz et al. | |
| 6,524,135 | B1 | 2/2003 | Feldman et al. | |
| 6,546,604 | B2 | 4/2003 | Galkiewicz et al. | |
| 6,588,074 | B2 | 7/2003 | Galkiewicz et al. | |
| 6,717,058 | B2 | 4/2004 | Booth et al. | |
| 6,763,556 | B2 | 7/2004 | Fagan et al. | |
| 6,831,230 | B2 | 12/2004 | Ide et al. | |
| 7,267,575 | B1 | 9/2007 | Hwang | |
| 7,329,141 | B2 | 2/2008 | Kumakura et al. | |
| 7,807,927 | B2 | 10/2010 | Yeh | |
| 8,492,655 | B2 | 7/2013 | Gundel | |
| 8,841,555 | B2 | 9/2014 | Gundel et al. | |
| 2002/0020545 | A1 | 2/2002 | Suzuki | |
| 2003/0085052 | A1 | 5/2003 | Tsao et al. | |
| 2003/0213610 | A1 | 11/2003 | Ide et al. | |
| 2006/0016615 | A1 | 1/2006 | Schilson et al. | |
| 2006/0054334 | A1 | 3/2006 | Vaupotic et al. | |
| 2006/0172588 | A1 | 8/2006 | Peng | |
| 2006/0207784 | A1 | 9/2006 | Chang | |
| 2007/0240898 | A1 | 10/2007 | Reichert et al. | |
| 2008/0041610 | A1 | 2/2008 | Cheng | |
| 2010/0186225 | A1 | 7/2010 | Reichert | |
| 2012/0090866 | A1 | 4/2012 | Gundel | |
| 2012/0090872 | A1 | 4/2012 | Gundel | |
| 2012/0090873 | A1 | 4/2012 | Gundel | |
| 2012/0097421 | A1 | 4/2012 | Gundel | |
| 2012/0267159 | A1 | 10/2012 | Gundel | |
| 2012/0285723 | A1 | 11/2012 | Gundel et al. | |
| 2013/0168149 | A1 | 7/2013 | Gundel | |

FOREIGN PATENT DOCUMENTS

| | | |
|---|---|---|
| DE | 2547152 | 4/1977 |
| DE | 2758472 | 12/1977 |
| DE | 3522173 | 7/1986 |
| EP | 0 082 700 | 6/1983 |
| EP | 103430 | 3/1984 |
| EP | 0 284 245 | 9/1988 |
| EP | 0 446 980 | 9/1991 |
| EP | 0 477 006 | 3/1992 |
| EP | 0 548 942 | 6/1993 |
| EP | 0 654 859 | 5/1995 |
| EP | 0 696 085 | 2/1996 |
| EP | 0 907 221 | 4/1999 |
| EP | 0 961 298 | 12/1999 |
| GB | 1 546 609 | 5/1979 |
| JP | 60 140309 | 9/1985 |
| JP | 61 133914 | 8/1986 |
| JP | 1023947 | 1/1989 |
| JP | 4 36906 | 2/1992 |
| JP | H06-5042 | 1/1994 |
| JP | 08-203350 | 8/1996 |
| JP | 2000082346 | 3/2000 |
| JP | 2001135157 | 5/2001 |
| JP | 2002-117731 | 4/2002 |
| JP | 2003281944 | 10/2003 |
| JP | 2005-116300 | 4/2005 |
| JP | 2006 286480 | 10/2006 |
| JP | 2007265640 | 10/2007 |
| JP | 4164979 | 8/2008 |
| JP | 2009093934 | 4/2009 |
| JP | 2010 097882 | 4/2010 |
| WO | WO 2006/113702 | 10/2006 |
| WO | WO 2009/130859 | 10/2009 |

* cited by examiner

SHIELDED ELECTRICAL RIBBON CABLE WITH DIELECTRIC SPACING

TECHNICAL FIELD

The present disclosure relates generally to shielded electrical cables for the transmission of electrical signals, in particular, to shielded electrical cables that can be mass-terminated and provide high speed electrical properties.

BACKGROUND

Due to increasing data transmission speeds used in modern electronic devices, there is a demand for electrical cables that can effectively transmit high speed electromagnetic signals (e.g., greater than 1 Gb/s). One type of cable used for these purposes are coaxial cables. Coaxial cables generally include an electrically conductive wire surrounded by an insulator. The wire and insulator are surrounded by a shield, and the wire, insulator, and shield are surrounded by a jacket. Another type of electrical cable is a shielded electrical cable having one or more insulated signal conductors surrounded by a shielding layer formed, for example, by a metal foil.

Both these types of electrical cable may require the use of specifically designed connectors for termination and are often not suitable for the use of mass-termination techniques, e.g., the simultaneous connection of a plurality of conductors to individual contact elements. Although electrical cables have been developed to facilitate these mass-termination techniques, these cables often have limitations in the ability to mass-produce them, in the ability to prepare their termination ends, in their flexibility, and in their electrical performance.

SUMMARY

The present disclosure is directed to electrical ribbon cables. In one embodiment, an electrical ribbon cable, comprises at least one conductor set comprising at least two elongated conductors extending from end-to-end of the cable, wherein each of the conductors are encompassed along a length of the cable by respective first dielectrics. The ribbon cable further comprises a first and second film extending from end-to-end of the cable and disposed on opposite sides of the cable, wherein the conductors are fixably coupled to the first and second films such that a consistent spacing is maintained between the first dielectrics of the conductors of each conductor set along the length of the cable. The ribbon cable further comprises a second dielectric disposed within the spacing between the first dielectrics of the wires of each conductor set.

In more particular embodiments, the second dielectric may comprise an air gap that extends continuously along the length of the cable between closest points of proximity between the first dielectrics of the conductors of each conductor set. In any of these embodiments, the first and second films may comprise first and second shielding films. In such a case, the first and second shielding films may be arranged so that, in a transverse cross section of the cable, at least one conductor is only partially surrounded by a combination of the first and second shielding films. In any of these configurations, the cable may further comprise a drain wire disposed along the length of the cable and in electrical communication with at least one of the first and second shielding films In any of these embodiments, at least one of the first and second films may be conformably shaped to, in transverse cross section of the cable, partially surround each conductor set. For example, both the first and second films may be in combination conformably shaped to, in transverse cross section of the cable, substantially surround each conductor set. In such case, flattened portions of the first and second films may be coupled together to form a flattened cable portion on each side of at least one conductor set.

In any of these embodiments, the first dielectrics of the conductors may be bonded to the first and second films. In such a case, at least one of the first and second films may comprise: a rigid dielectric layer; a shielding film fixably coupled to the rigid dielectric layer; and a deformable dielectric adhesive layer that bonds the first dielectrics of the conductors to the rigid dielectric layer.

In any of these embodiments, the cable may further comprise one or more insulating supports fixably coupled between the first and second films along the length of the cable. In such case, at least one of the insulating supports may be disposed between two adjacent conductor sets, and or at least one of the insulating supports may be disposed between the conductor set and a longitudinal edge of the cable.

In any of these embodiments, a dielectric constant of the first dielectrics may be higher than a dielectric constant of the second dielectric. Also in any of these embodiments, the at least one conductor set may be adapted for maximum data transmission rates of at least 1 Gb/s.

In another embodiment of the invention, an electrical ribbon cable, comprises a plurality of conductor sets each comprising a differential pair of wires extending from end-to-end of the cable, wherein each of the wires are encompassed by respective dielectrics. The cable further comprises first and second shielding films extending from end-to-end of the cable and disposed on opposite sides of the cable. The wires are bonded to the first and second films such that a consistently spaced air gap extends continuously along a length of the cable between closest points of proximity between the dielectrics of the wires of each differential pair. The first and second shielding films are conformably shaped to, in combination, substantially surround each conductor set in transverse cross section. Further, flattened portions of the first and second shielding films are coupled together to form a flattened cable portion on each side of each of the conductor sets.

In this other embodiment, at least one of the first and second shielding films may comprise: a deformable dielectric adhesive layer bonded to the wires; a rigid dielectric layer coupled to the deformable dielectric layer; and a shielding film coupled to the rigid dielectric layer. Further, any of these other cable embodiments may include at least one of the conductor sets that is adapted for maximum data transmission rates of at least 1 Gb/s.

These and various other characteristics are pointed out with particularity in the claims annexed hereto and form a part hereof. Reference should also be made to the drawings which form a further part hereof, and to accompanying descriptive matter, in which there are illustrated and described representative examples of systems, apparatuses, and methods in accordance with embodiments of the invention.

BRIEF DESCRIPTION OF THE DRAWINGS

The invention is described in connection with the embodiments illustrated in the following diagrams.

FIG.

In the figures, like reference numerals designate like elements.

DETAILED DESCRIPTION

In the following description, reference is made to the accompanying drawings that form a part hereof, and in which is shown by way of illustration various embodiments in which the invention may be practiced. It is to be understood that other embodiments may be utilized, as structural and operational changes may be made without departing from the scope of the present invention. The following detailed description, therefore, is not to be taken in a limiting sense, and the scope of the invention is defined by the appended claims.

A growing number of applications require high speed high signal integrity connections. These applications may use twin axial ("twinax") transmission lines that include parallel pairs of differentially-driven conductors. Each pair of conductors may be dedicated to a data transmission channel. The construction of choice for these purposes is often a loose bundle of paired conductors that are jacketed/wrapped by a shield or other covering. Applications are demanding more speed from these channels and more channels per assembly. As a result, some applications are demanding cables with improved termination signal integrity, termination cost, impedance/skew control, and cable cost over current twinax transmission lines.

The present disclosure is generally directed to a shielded electrical ribbon cable that suitable for differentially driven conductor sets. Such cables can include precise dielectric gaps between conductors. These gaps, which may include air and/or other dielectric materials, can decrease dielectric constant and loss, decrease cable stiffness and thickness, and reduce crosstalk between adjacent signal lines. In addition, due to the ribbon construction, the cable can readily be terminated to a printed circuit board connector of similar pitch. Such a termination can provide very high termination signal integrity.

The constructions disclosed herein may generally include parallel insulated wires that are bonded to a substrate on one or both sides with specific placement of gaps between conductors. The substrates may or may not contain a ground plane. Such a cable may be used as an alternative to conventional bundled, e.g., differential pair, twin-axial (twinax) constructions and is expected to have lower cable cost, termination cost, skew, and termination parasitics.

Section 1: Shielded Electrical Cable Dielectric Configurations

Figure 1A:
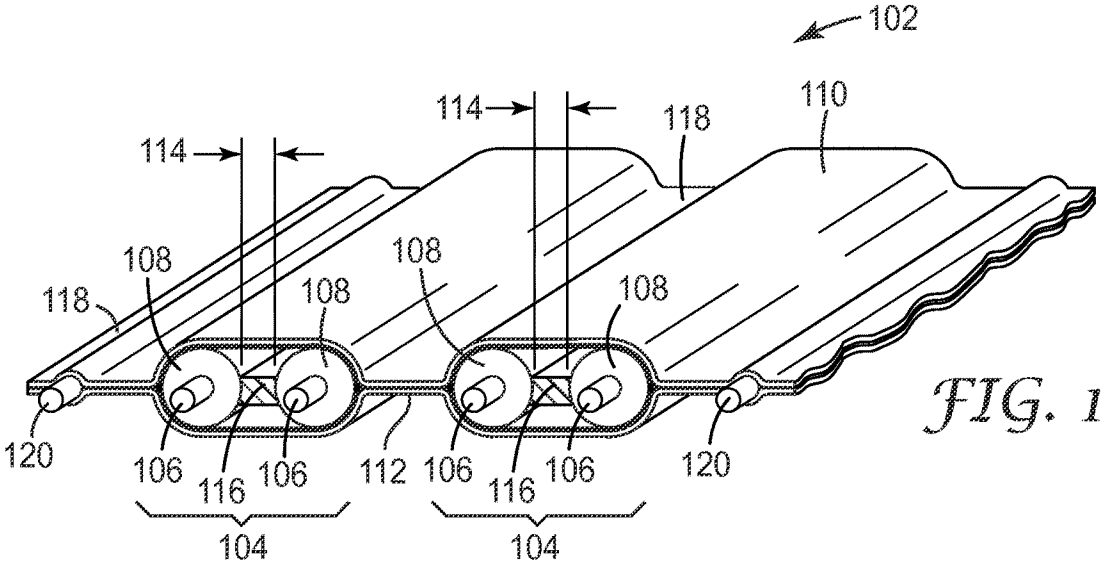
FIG. 1*a* is a perspective view of an example cable construction.
Figure 1B:
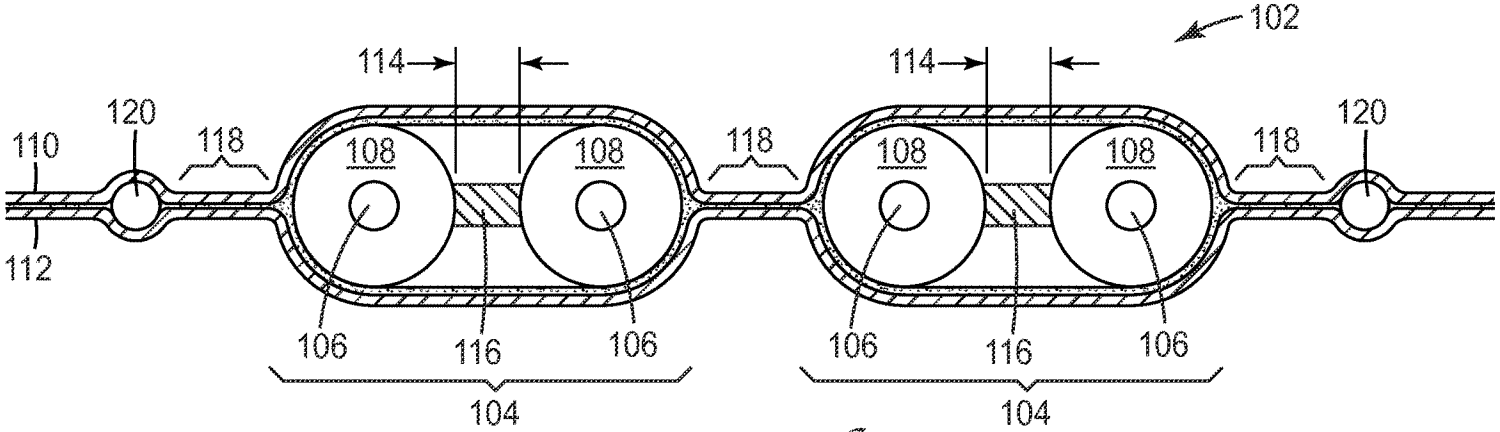
FIG. 1*b* is a cross section view of the example cable construction of FIG. 1*a;*

In reference now to FIGS. 1*a* and 1*b*, respective perspective and cross sectional views shows a cable construction (or portions thereof) according to an example embodiment of the invention. Generally, an electrical ribbon cable 102 includes one or more conductor sets 104. Each conductor set 104 includes two or more conductors (e.g., wires) 106 extending from end-to-end along the length of the cable 102. The conductor sets 104 may be suitable for high speed transmission (e.g., single or differentially driven at data rates of 1 Gb/sec or higher). Each of the conductors 106 is encompassed by a first dielectric 108 along the length of the cable. The conductors 106 are affixed to first and second films 110, 112 that extend from end-to-end of the cable 102 and are disposed on opposite sides of the cable 102. A consistent spacing 114 is maintained between the first dielectrics 108 of the conductors 106 of each conductor set 104 along the length of the cable 102. A second dielectric 116 is disposed within the spacing 114. The dielectric 116 may include an air gap/void and/or some other material.

The spacing 114 between members of the conductor sets 104 can be made consistent enough such that the cable 102 has equal or better electrical characteristics than a standard wrapped twinax cable, along with improved ease of termination and signal integrity of the termination. The films 110, 112 may include shielding material such as metallic foil, and the films 110, 112 may be conformably shaped to substantially surround the conductor sets 104. In the illustrated example, films 110, 112 are pinched together to form flat portions 118 extending lengthwise along the cable 102 outside of and/or between conductor sets 104. In the flat portions 118, the films 110, 112 substantially surround the conductor sets 104, e.g., surround a perimeter of the conductor sets 104 except where a small layer (e.g., of insulators and/or adhesives) the films 110, 112 join each other. For example, cover portions of the shielding films may collectively encompass at least 75% or more of the perimeter of any given conductor set. While the films 110, 112 may be shown here (and elsewhere herein) as separate pieces of film, those of skill in the art will appreciate that the films 110, 112 may alternatively be formed from a single sheet of film, e.g., folded around a longitudinal path/line to encompass the conductor sets 104.

The cable 102 may also include additional features, such as one or more ground/drain wires 120. The drain wires 120 may be electrically coupled to shielded films 110, 112 continually or at discrete locations along the length of the cable 102. Or the wires 120 may be connected to grounded connections at the ends of the cable 102. Generally the drain wire 102 may provide convenient access at one or both ends of the cable for electrically terminating (e.g., grounding) the shielding material. The drain/ground wire 120 may also be configured to provide some level of DC coupling between the films 110, 112, e.g., where both films 110, 112 include shielding material.

Figure 2A:
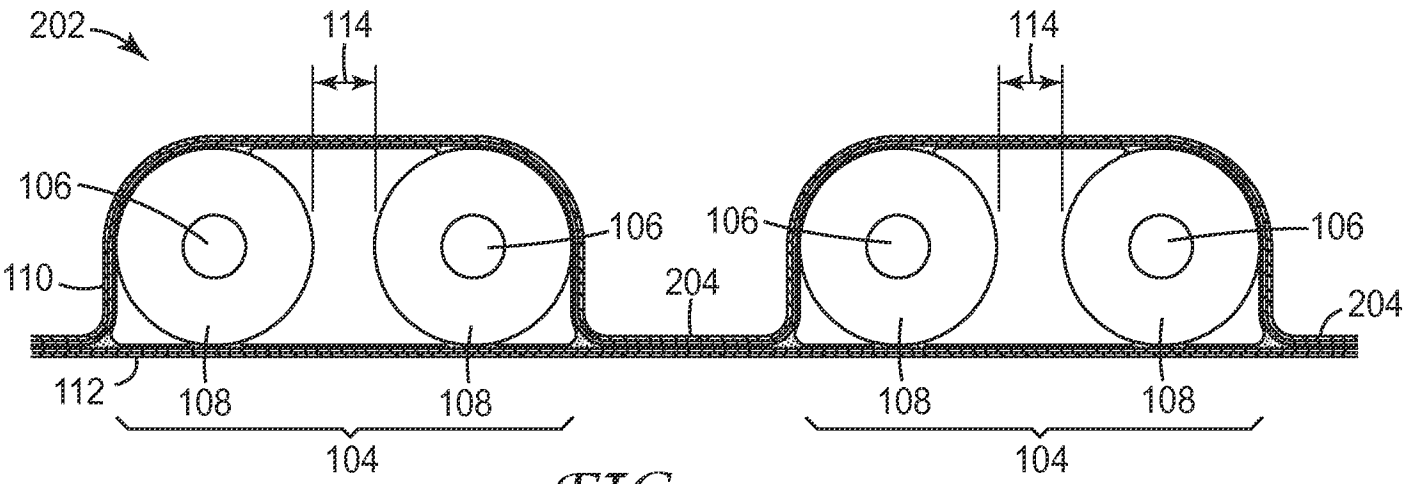
FIGS. 2*a*-2*c* are a cross section views of example alternate cable constructions.
Figure 2B:
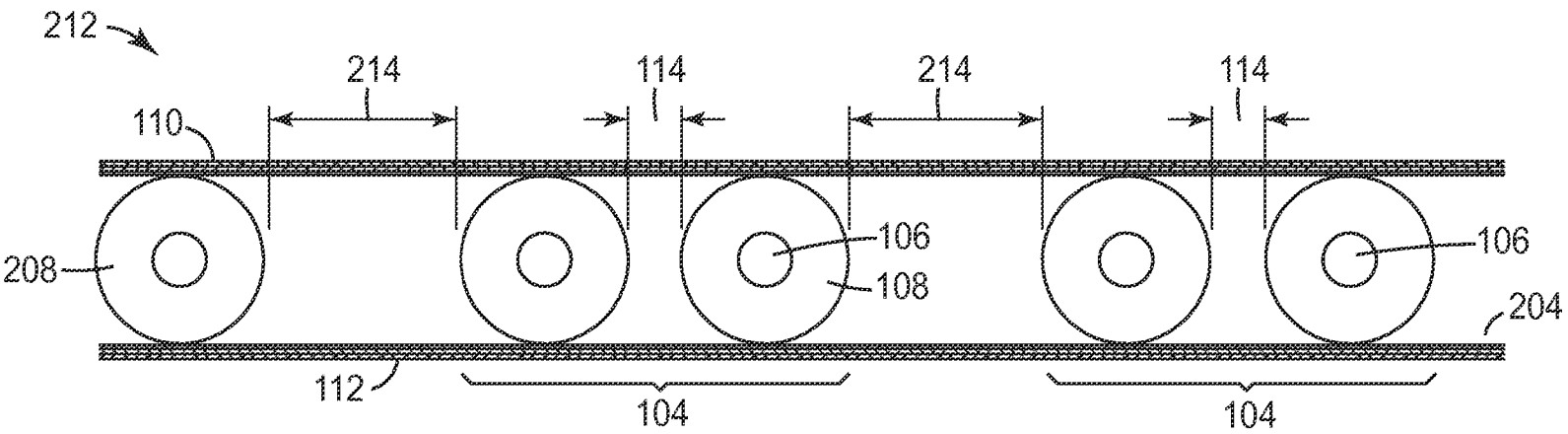
Figure 2C:
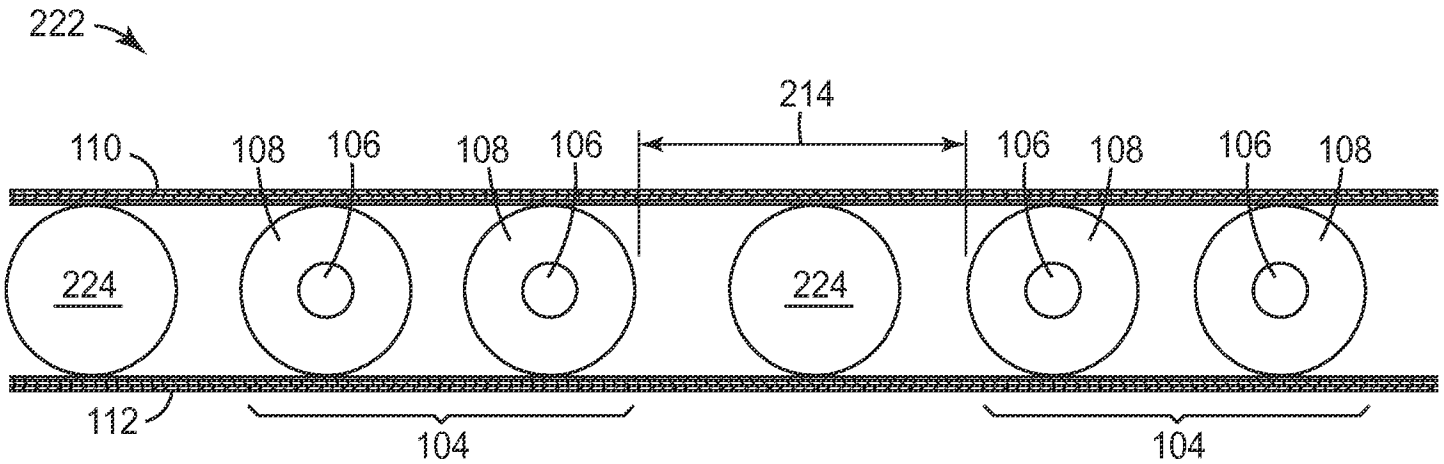

In reference now to FIGS. 2*a*-2*c*, cross-section diagrams illustrate various alternate cable construction arrangements (or portions thereof), wherein the same reference numbers may be used to indicate analogous components as in other figures. In FIG. 2*a*, cable 202 may be of a similar construction as shown in FIGS. 1*a*-1*b*, however only one film 110 is conformably shaped around the conductor sets to form pinched/flat portions 204. The other film 112 is substantially planar on one side of the cable 202. This cable 202 (as well as cables 212 and 222 in FIGS. 2*b*-2*c*) uses air in the gaps 114 as a second dielectric between first dielectrics 108, therefore there is no explicit second dielectric material 116 shown between closest points of proximity of the first dielectrics 108. For purposes of further discussion, the air gap 114 will be understood to represent either and air dielectric or an alternate dielectric material, such as material 116 seen in FIGS. 1*a* and 1*b*. Further, a drain/ground wire is not shown in these alternate arrangements, but can be adapted to include drain/ground wires as discussed elsewhere herein.

In FIGS. 2*b* and 2*c*, cable arrangements 212 and 222 may be of a similar construction as those previously described, but here both films are configured to be substantially planar along the outer surfaces of the cables 212, 222. In cable 212, there are voids/gaps 214 between conductor sets 104. As shown here, these gaps 214 are larger than gaps 114 between members of the sets 104, although this cable configuration need not be so limited. In addition to this gap 214, cable 222 of FIG. 2*c* includes supports/spacers 224 disposed in the gap 214 between conductor sets 104 and or outside of the conductor sets 104 (e.g., between a conductor set 104 and a longitudinal edge of the cable).

The supports 224 may be fixably attached (e.g., bonded) to films 110, 112 and assist in providing structural stiffness and/or adjusting electrical properties of the cable 222. The supports 224 may include any combination of dielectric, insulating, and/or shielding materials for tuning the mechanical and electrical properties of the cable 222 as desired. The supports 224 are shown here as circular in cross-section, but be configured as having alternate cross sectional shapes such as ovular and rectangular. The supports 224 may be formed separately and laid up with the conductor sets 104 during cable construction. In other variations, the supports 224 may be formed as part of the films 110, 112 and/or be assembled with the cable 222 in a liquid form (e.g., hot melt).

The cable constructions 102, 202, 212, 222 described above may include other features not illustrated. For example, in addition to signal wires, drain wires, and ground wires, the cable may include one or more additional isolated wires sometime referred to as sideband. Sideband can be used to transmit power or any other signals of interest. Sideband wires (as well as drain wires) may be enclosed within the films 110, 112 and/or may be disposed outside the films 110, 112, e.g., being sandwiched between the films and an additional layer of material.

The variations described above may utilize various combinations of materials and physical configurations based on the desired cost, signal integrity, and mechanical properties of the resulting cable. One consideration is the choice of the second dielectric material 116 positioned in the gap 114 between conductor sets 104 as seen in FIGS. 1*a* and 1*b*, and represented elsewhere by the gap 114 alone. This second dielectric may be of interest in cases where the conductor sets include a differential pair, are one ground and one signal, and/or are carrying two interfering signals. For example, use of an air gap 114 as a second dielectric may result in a low dielectric constant and low loss. Use of an air gap 114 may also have other advantages, such as low cost, low weight, and increased cable flexibility. However, precision processing may be required to ensure consistent spacing of the conductors that form the air gaps 114 along a length of the cable.

Figure 3A:
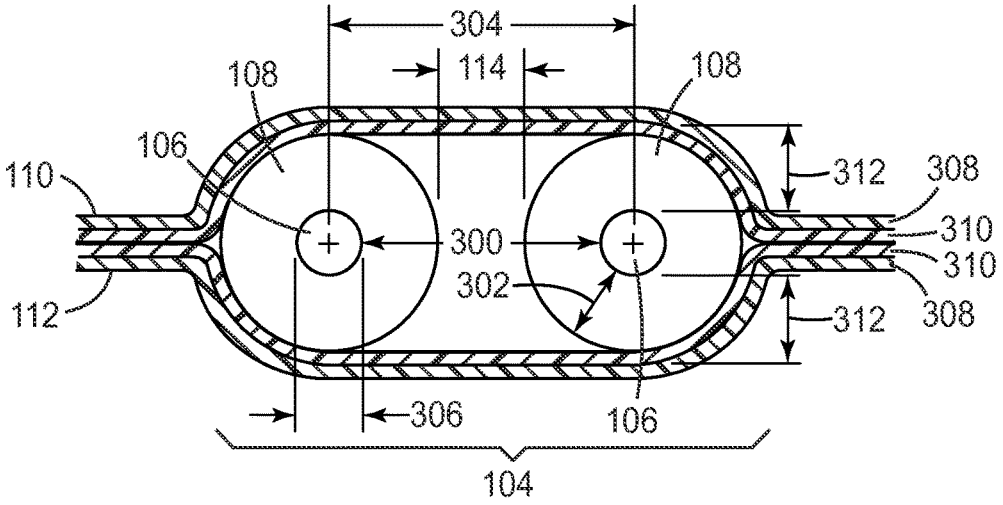
FIG. 3*a* is a cross section of a portion of an example cable showing dimensions of interest.

In reference now to FIG. 3*a*, a cross sectional view of a conductor set 104 identifies parameters of interest in maintaining a consistent dielectric constant between conductors 106. Generally, the dielectric constant of the conductor set 104 may be sensitive to the dielectric materials between the closest points of proximity between the conductors of the set 104, as represented here by dimension 300. Therefore, a consistent dielectric constant may be maintained by maintaining consistent thicknesses 302 of the dielectric 108 and consistent size of gap 114 (which may be an air gap or filled with another dielectric material such as dielectric 116 shown in FIG. 1*a*).

It may be desirable to tightly control geometry of coatings of both the conductor 106 and the conductive film 110, 112 in order to ensure consistent electrical properties along the length of the cable. For the wire coating, this may involve coating the conductor 106 (e.g., solid wire) precisely with uniform thickness of insulator/dielectric material 108 and ensuring the conductor 106 is well-centered within the coating 108. The thickness of the coating 108 can be increased or decreased depending on the particular properties desired for the cable. In some situations, a conductor with no coating may offer optimal properties (e.g., dielectric constant, easier termination and geometry control), but for some applications industry standards require that a primary insulation of a minimum thickness is used. The coating 108 may also be beneficial because it may be able to bond to the dielectric substrate material 110, 112 better than bare wire. Regardless, the various embodiments described above may also include a construction with no insulation thickness.

The dielectric 108 may be formed/coated over the conductors 106 using a different process/machinery than used to assemble the cable. As a result, during final cable assembly, tight control over variation in the size of the gap 114 (e.g., the closest point of proximity between the dielectrics 108) may be of primary concern to ensure maintaining constant dielectric constant. Depending on the assembly process and apparatus used, a similar result may be had by controlling a centerline distance 304 between the conductors 106 (e.g., pitch). The consistency of this may depend on how tightly the outer diameter dimension 306 of the conductors 106 can be maintained, as well as consistency of dielectric thickness 302 all around (e.g., concentricity of conductor 106 within dielectric 108). However, because dielectric effects are strongest at the area of closest proximity of the conductors 106, if thickness 302 can be controlled at least near the area of closest proximity of adjacent dielectrics 108, then consistent results may be obtained during final assembly by focusing on controlling the gap size 114.

The signal integrity (e.g., impedance and skew) of the construction may not only depend on the precision/consistency of placing the signal conductors 106 relative to each other, but also in precision of placing the conductors 106 relative to a ground plane. As shown in FIG. 3*a*, films 110 and 112 include respective shielding and dielectric layers 308, 310. The shielding layer 308 may act as a ground plane in this case, and so tight control of dimension 312 along the length of the cable may be advantageous. In this example, dimension 312 is shown being the same relative to both the top and bottom films 110, 112, although it is possible for these distances to be asymmetric in some arrangements (e.g., use of different dielectric 310 thicknesses/constants of films 110, 112, or one of the films 110,112 does not have the dielectric layer 310).

Figure 3B:
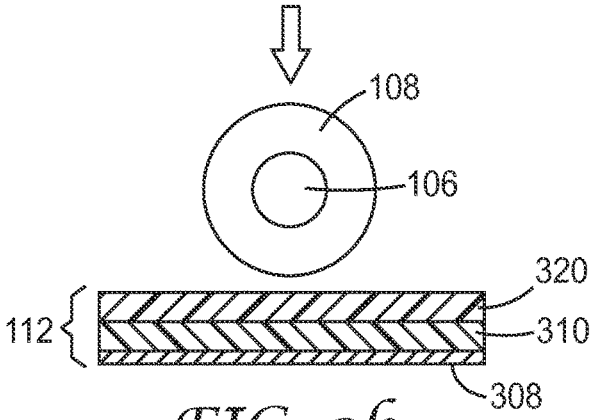
FIGS. 3*b* and 3*c* are block diagrams illustrating steps of an example manufacturing procedure.

One challenge in manufacturing a cable as shown in FIG. 3*a* may be to tightly control distance 312 (and/or equivalent conductor to ground plane distances) when the insulated conductors 106, 108 are attached to the conductive film 110, 112. In reference now to FIGS. 3*b-c*, block diagrams illustrate an example of how consistent conductor to ground plane distances may be maintained during manufacture according to an embodiment of the invention. In this example a film (which by way of example is designated as film 112) includes a shielding layer 308 and dielectric layer 310 as previously described.

Figure 3C:
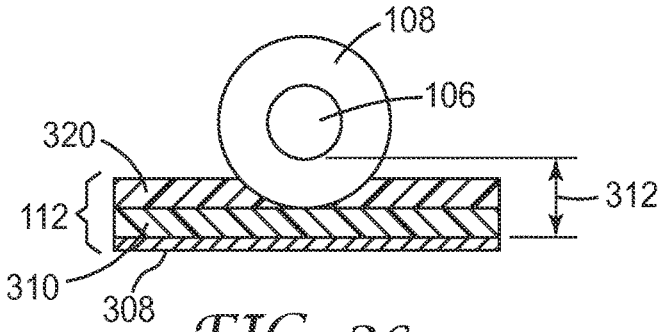

To help ensure a consistent conductor to ground plane distance (e.g., distance 312 seen in FIG. 3*c*) the film 112 uses a multilayer coated film as the base (e.g., layers 308 and 310). A known and controlled thickness of deformable material 320 (e.g., a hot melt adhesive), is placed on the less deformable film base 308, 310. As the insulated wire 106, 108 is pressed into the surface, the deformable material 320 deforms until the wire 106, 108 presses down to a depth controlled by the thickness of deformable material 320, as seen in FIG. 3*c*. An example of materials 320, 310, 308 may include a hot melt 320 placed on a polyester backing 308 or 310, where the other of layers 308, 310 includes a shielding material. Alternatively, or in addition to this, tool features can press the insulated wire 106, 108 into the film 112 at a controlled depth.

In some embodiments described above, an air gap 114 exists between the insulated conductors 106, 108 at the mid-plane of the conductors. This may be useful in many end applications, include between differential pair lines, between ground and signal lines (GS) and/or between victim and aggressor signal lines. An air gap 114 between ground and signal conductors may exhibit similar benefits as described for the differential lines, e.g., thinner construction and lower dielectric constant. For two wires of a differential pair, the air gap 114 can separate the wires, which provides less coupling and therefore a thinner construction than if the gap were not present (providing more flexibility, lower cost, and less crosstalk). Also, because of the high fields that exist between the differential pair conductors at this closest line of approach between them, the lower capacitance in this location contributes to the effective dielectric constant of the construction.

Figure 4A:
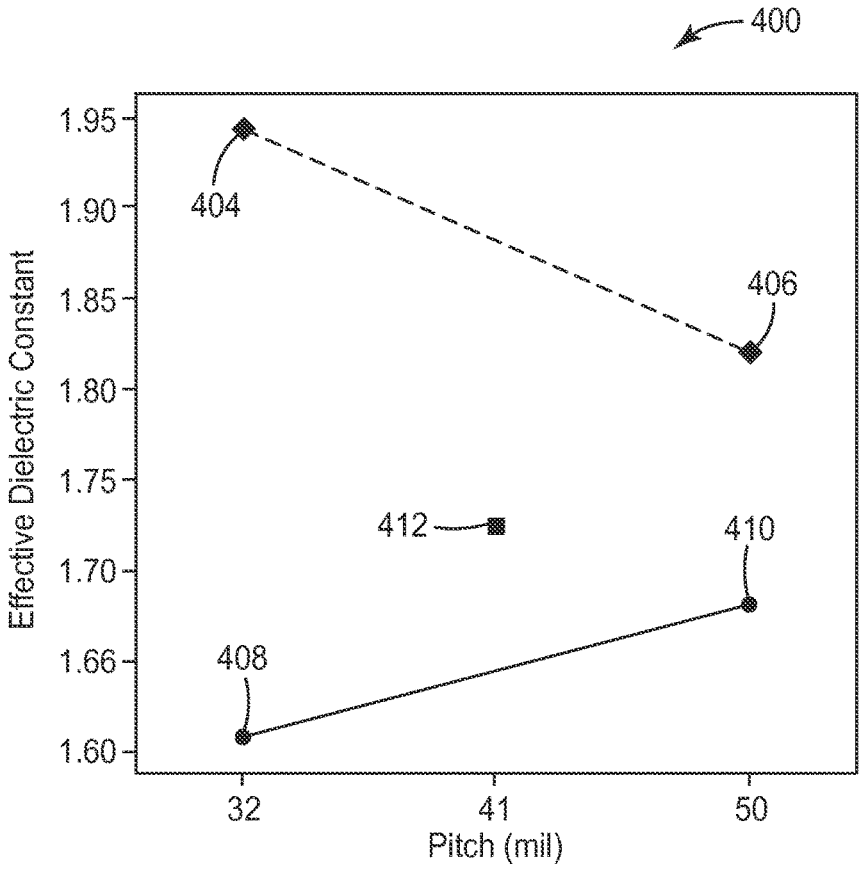
FIG. 4*a* is a graph illustrating results of analysis of example cable constructions.
Figure 4B:
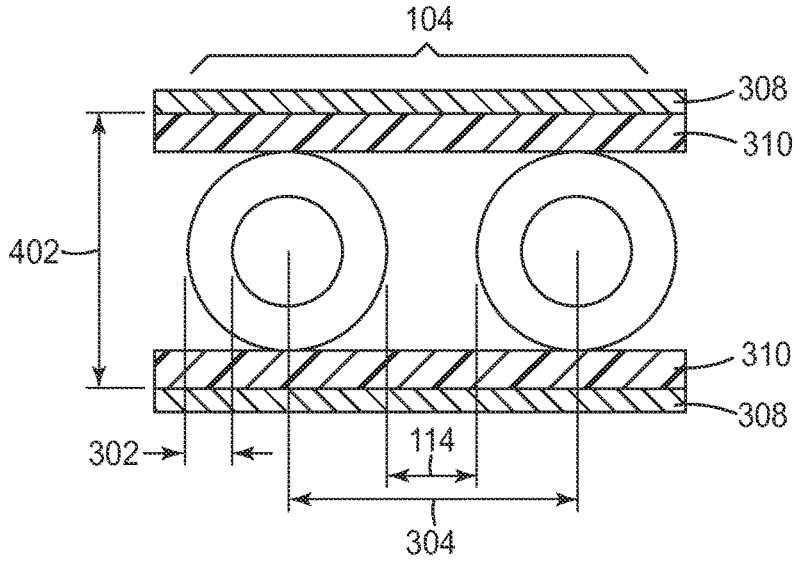
FIG. 4*b* is a cross section showing additional dimensions of interest relative to the analysis of FIG. 4*a;*

In reference now to FIG. 4*a*, a graph 400 illustrates an analysis of dielectric constants of cable constructions according to various embodiments. In FIG. 4*b*, a block diagram includes geometric features of a conductor set according to an example of the invention which will be referred to in discussing FIG. 4*a*. Generally, the graph 400 illustrates differing dielectric constants obtained for different cable pitch 304, insulation/dielectric thickness 302, and cable thickness 402 (the latter which may exclude thickness of outer shielding layer 308). This analysis assumes a 26 AWG differential pair conductor set 104, 100 ohms impedance, and solid polyolefin used for insulator/dielectric 108 and dielectric layers 310. Points 404 and 406 are results for 8 mil thick insulation and respective 56 and 40 mil cable thicknesses 402. Points 408 and 410 are results for 1 mil thick insulation and respective 48 and 38 mil cable thicknesses 402. Point 412 is a result for 4.5 mil thick insulation with a 42 mil cable thickness 402.

As seen in the graph 400, thinner insulation around wire tends to lower the effective dielectric constant. If the insulation is very thin, a tighter pitch may then tend to reduce the dielectric constant because of the high fields between the wires. If the insulation is thick, however, the greater pitch provides more air around the wires and lowers the effective dielectric constant. For two signal lines that can interfere with one another, the air gap is an effective feature for limiting the capacitive crosstalk between them. If the air gap is sufficient, a ground wire may not be needed between signal lines, which would result in cost savings.

The dielectric loss and dielectric constant seen in graph 400 may be reduced by the incorporation of air gaps between the insulated conductors. The reduction due to these gaps is on the same order (e.g., 1.6-1.8 for polyolefin materials) as can be achieved a conventional construction that uses a foamed insulation around the wires. Foamed primary insulation 108 can also be used in conjunction with the constructions described herein to provide an even lower dielectric constant and lower dielectric loss. Also, the backing dielectric 310 can be partially or fully foamed.

A potential benefit of using the engineered air gap 114 instead of foaming is that foaming can be inconsistent along the conductor 106 or between different conductors 106 leading to variations in the dielectric constant and propagation delay which increases skew and impedance variation. With solid insulation 108 and precise gaps 114, the effective dielectric constant may be more readily controlled and, in turn, leading to consistency in electrical performance, including impedance, skew, attenuation loss, insertion loss, etc.

Section 2: Additional Shielded Electrical Cable Configurations

In this section, additional features are shown and described that may be applicable to the cables constructions described above. As with the previous discussion, the inclusion of an air gap/dielectric in the figures and description is intended to cover dielectrics made of both air and/or other materials.

Figure 14A:
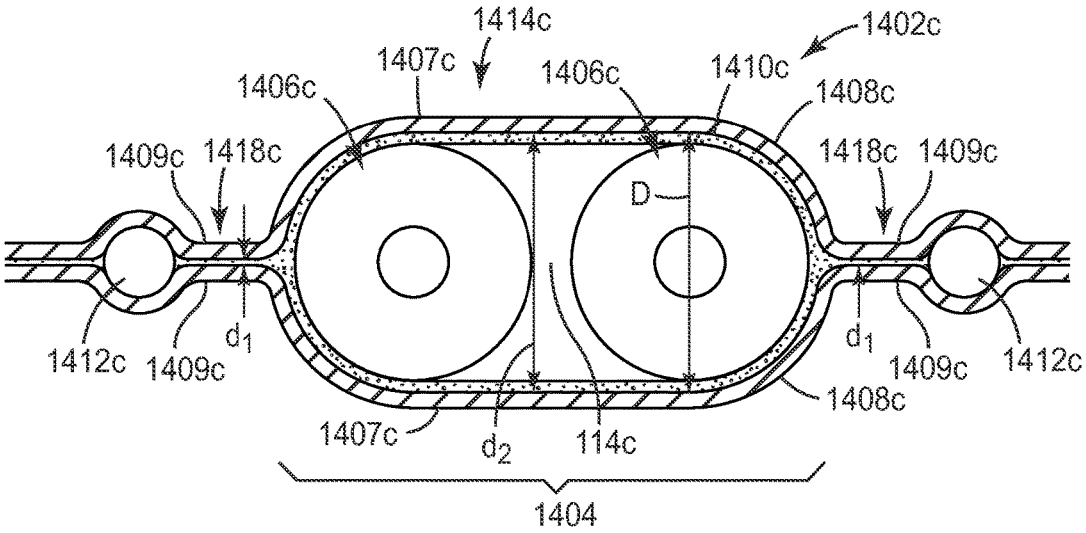
FIGS. 14*a*-14*e* are front cross-sectional views of further exemplary shielded electrical cables.

In reference now to FIGS. 14*a*-14*e*, the cross-sectional views of these figures may represent various shielded electrical cables, or portions thereof. Referring to FIG. 14*a*, shielded electrical cable 1402*c* has a single conductor set 1404*c* which has two insulated conductors 1406*c* separated by dielectric gap 114*c*. If desired, the cable 1402*c* may be made to include multiple conductor sets 1404*c* spaced part across a width of the cable 1402*c* and extending along a length of the cable. Insulated conductors 1406*c* are arranged generally in a single plane and effectively in a twinaxial configuration. The twin axial cable configuration of FIG. 14*a* can be used in a differential pair circuit arrangement or in a single ended circuit arrangement.

Two shielding films 1408*c* are disposed on opposite sides of conductor set 1404*c*. The cable 1402*c* includes a cover region 1414*c* and pinched regions 1418*c*. In the cover region 1414*c* of the cable 1402*c*, the shielding films 1408*c* include cover portions 1407*c* that cover the conductor set 1404*c*. In transverse cross section, the cover portions 1407*c*, in combination, substantially surround the conductor set 1404*c*. In the pinched regions 1418*c* of the cable 1402*c*, the shielding films 1408*c* include pinched portions 1409*c* on each side of the conductor set 1404*c*.

An optional adhesive layer 1410*c* may be disposed between shielding films 1408*c*. Shielded electrical cable 1402*c* further includes optional ground conductors 1412*c* similar to ground conductors 1412 that may include ground wires or drain wires. Ground conductors 1412*c* are spaced apart from, and extend in substantially the same direction as, insulated conductors 1406*c*. Conductor set 1404*c* and ground conductors 1412*c* can be arranged so that they lie generally in a plane.

As illustrated in the cross section of FIG. 14*a*, there is a maximum separation, D, between the cover portions 1407*c* of the shielding films 1408*c*; there is a minimum separation, d1, between the pinched portions 1409*c* of the shielding films 1408*c*; and there is a minimum separation, d2, between the shielding films 1408*c* between the insulated conductors 1406*c*.

In FIG. 14*a*, adhesive layer 1410*c* is shown disposed between the pinched portions 1409*c* of the shielding films 1408*c* in the pinched regions 1418*c* of the cable 102*c* and disposed between the cover portions 1407*c* of the shielding films 1408*c* and the insulated conductors 1406*c* in the cover region 1414*c* of the cable 1402*c*. In this arrangement, the adhesive layer 1410*c* bonds the pinched portions 1409*c* of the shielding films 1408*c* together in the pinched regions 1418*c* of the cable 1402*c*, and also bonds the cover portions 1407*c* of the shielding films 1408*c* to the insulated conductors 1406*c* in the cover region 1414*c* of the cable 1402*c*.

Figure 14B:
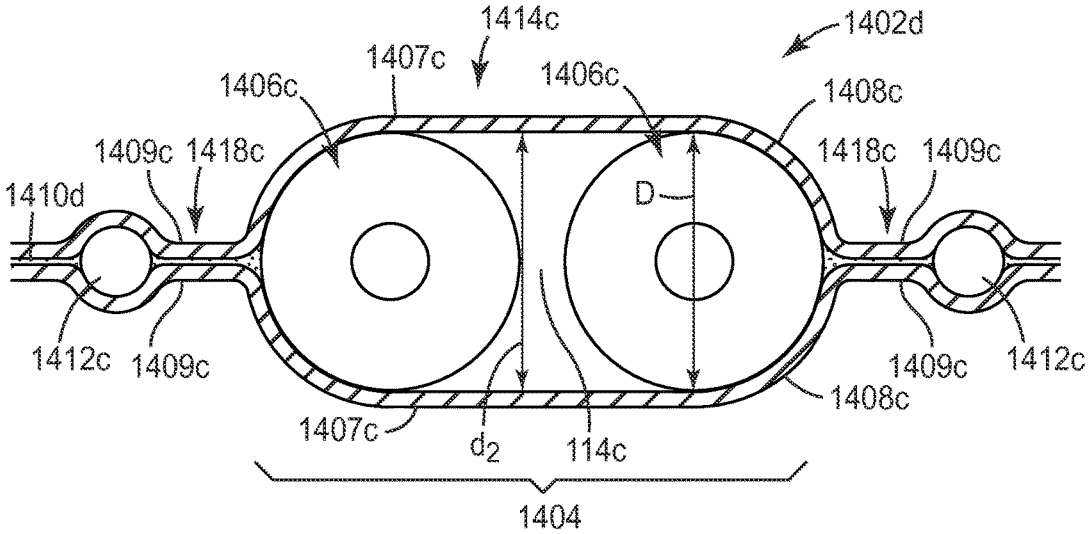

Shielded cable 1402*d* of FIG. 14*b* is similar to cable 1402*c* of FIG. 14*a*, with similar elements identified by similar reference numerals, except that in cable 1402*d* the optional adhesive layer 1410*d* is not present between the cover portions 1407*c* of the shielding films 1408*c* and the insulated conductors 1406*c* in the cover region 1414*c* of the cable. In this arrangement, the adhesive layer 1410*d* bonds the pinched portions 1409*c* of the shielding films 1408*c* together in the pinched regions 1418*c* of the cable, but does not bond the cover portions 1407*c* of the shielding films 1408*c* to the insulated conductors 1406*c* in the cover region 1414*c* of the cable 1402*d*.

Figure 14C:
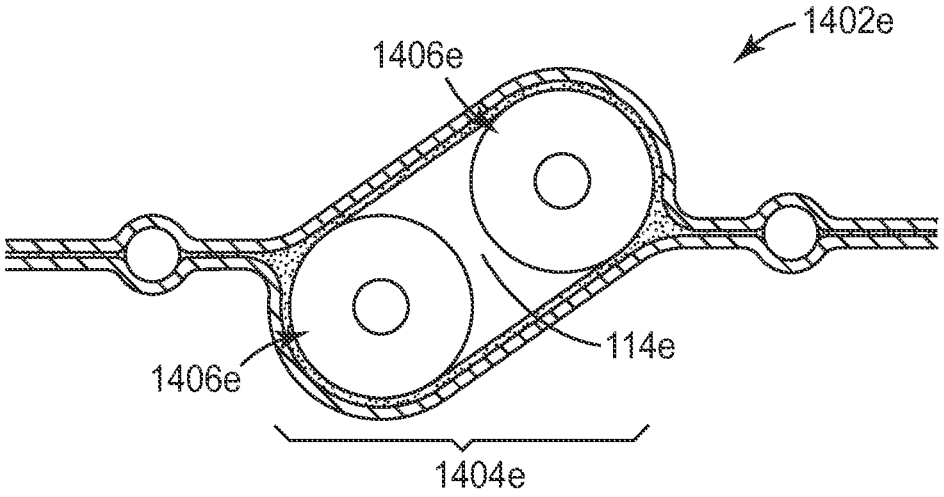

Referring now to FIG. 14*c*, we see there a transverse cross-sectional view of a shielded electrical cable 1402*e* similar in many respects to the shielded electrical cable 1402*c* of FIG. 14*a*. Cable 1402*e* includes a single conductor set 1404*e* that has two insulated conductors 1406*e* separated by dielectric gap 114*e* extending along a length of the cable 1402*e*. Cable 1402*e* may be made to have multiple conductor sets 1404*e* spaced apart from each other across a width of the cable 1402*e* and extending along a length of the cable 1402*e*. Insulated conductors 1406*e* are arranged effectively in a twisted pair cable arrangement, whereby insulated conductors 1406*e* twist around each other and extend along a length of the cable 1402*e*.

Figure 14D:
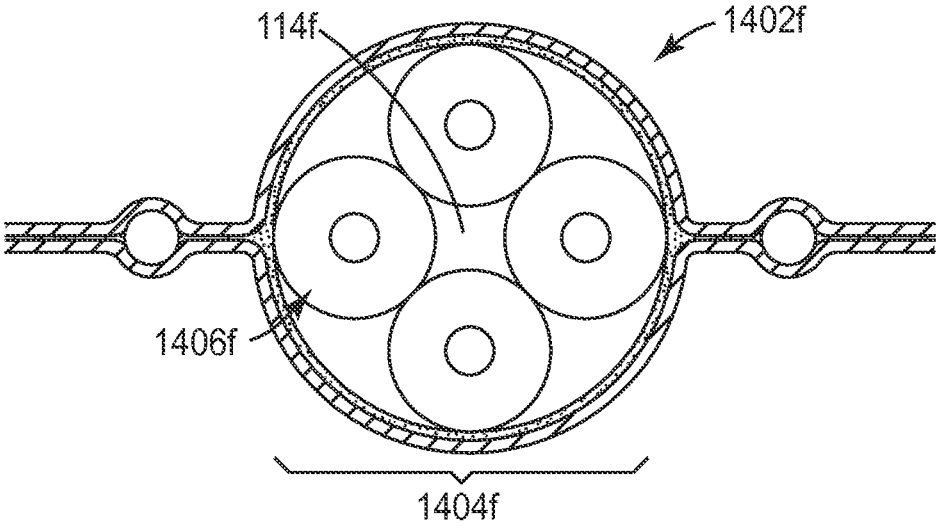

In FIG. 14*d* another shielded electrical cable 1402*f* is depicted that is also similar in many respects to the shielded electrical cable 1402*c* of FIG. 14*a*. Cable 1402*f* includes a single conductor set 1404*f* that has four insulated conductors 1406*f* extending along a length of the cable 1402*f*, with opposing conductors being separated by gap 114*f*. The cable 1402*f* may be made to have multiple conductor sets 1404*f* spaced apart from each other across a width of the cable 1402*f* and extending along a length of the cable 1402*f*. Insulated conductors 1406*f* are arranged effectively in a quad cable arrangement, whereby insulated conductors 1406*f* may or may not twist around each other as insulated conductors 1406*f* extend along a length of the cable 1402*f*.

Figure 14E:
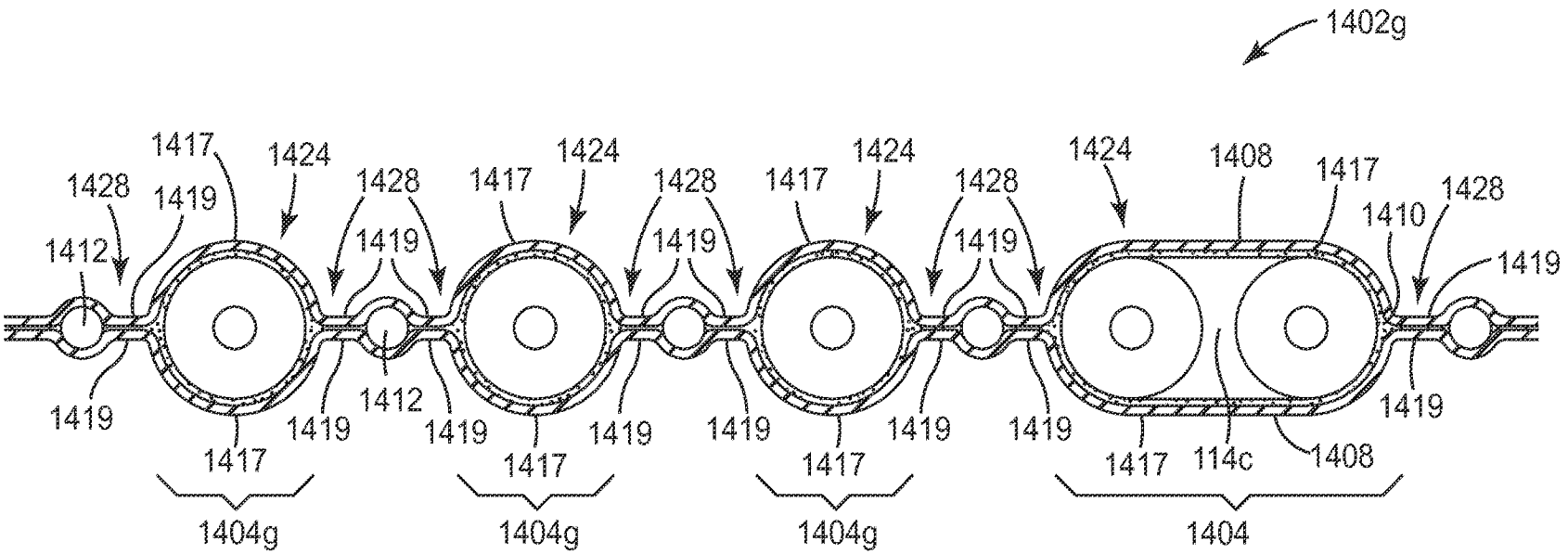

Further embodiments of shielded electrical cables may include a plurality of spaced apart conductor sets 1404, 1404*e*, or 1404*f*, or combinations thereof, arranged generally in a single plane. Optionally, the shielded electrical cables may include a plurality of ground conductors 1412 spaced apart from, and extending generally in the same direction as, the insulated conductors of the conductor sets. In some configurations, the conductor sets and ground conductors can be arranged generally in a single plane. FIG. 14*e* illustrates an exemplary embodiment of such a shielded electrical cable.

Referring to FIG. 14*e*, shielded electrical cable 1402*g* includes a plurality of spaced apart conductor sets 1404, 1404*g* arranged generally in plane. Conductor sets 1404*g* include a single insulated conductor, but may otherwise be formed similarly to conductor set 1404. Shielded electrical cable 1402*g* further includes optional ground conductors 1412 disposed between conductor sets 1404, 1404*g* and at both sides or edges of shielded electrical cable 1402*g*.

First and second shielding films 1408 are disposed on opposite sides of the cable 1402*g* and are arranged so that, in transverse cross section, the cable 1402*g* includes cover regions 1424 and pinched regions 1428. In the cover regions 1424 of the cable, cover portions 1417 of the first and second shielding films 1408 in transverse cross section substantially surround each conductor set 1404, 1404*c*. Pinched portions 1419 of the first and second shielding films 1408 form the pinched regions 1418 on two sides of each conductor set 1404, 1404*c*.

The shielding films 1408 are disposed around ground conductors 1412. An optional adhesive layer 1410 is disposed between shielding films 1408 and bonds the pinched portions 1419 of the shielding films 1408 to each other in the pinched regions 1428 on both sides of each conductor set 1404, 1404*c*. Shielded electrical cable 1402*g* includes a combination of coaxial cable arrangements (conductor sets 1404*g*) and a twinaxial cable arrangement (conductor set 1404) and may therefore be referred to as a hybrid cable arrangement.

One, two, or more of the shielded electrical cables may be terminated to a termination component such as a printed circuit board, paddle card, or the like. Because the insulated conductors and ground conductors can be arranged generally in a single plane, the disclosed shielded electrical cables are well suited for mass-stripping, i.e., the simultaneous stripping of the shielding films and insulation from the insulated conductors, and mass-termination, i.e., the simultaneous terminating of the stripped ends of the insulated conductors and ground conductors, which allows a more automated cable assembly process. This is an advantage of at least some of the disclosed shielded electrical cables. The stripped ends of insulated conductors and ground conductors may, for example, be terminated to contact conductive paths or other elements on a printed circuit board, for example. In other cases, the stripped ends of insulated conductors and ground conductors may be terminated to any suitable individual contact elements of any suitable termination device, such as, e.g., electrical contacts of an electrical connector.

In FIGS. 15*a*-15*d* an exemplary termination process of shielded electrical cable 1502 to a printed circuit board or other termination component 1514 is shown. This termination process can be a mass-termination process and includes the steps of stripping (illustrated in FIGS. 15*a*-15*b*), aligning (illustrated in FIG. 15*c*), and terminating (illustrated in FIG. 15*d*). When forming shielded electrical cable 1502, which may in general take the form of any of the cables shown and/or described herein, the arrangement of conductor sets 1504, 1504*a* (the latter having dielectric/gap 1520), insulated conductors 1506, and ground conductors 1512 of shielded electrical cable 1502 may be matched to the arrangement of contact elements 1516 on printed circuit board 1514, which would eliminate any significant manipulation of the end portions of shielded electrical cable 1502 during alignment or termination.

Figure 15A:
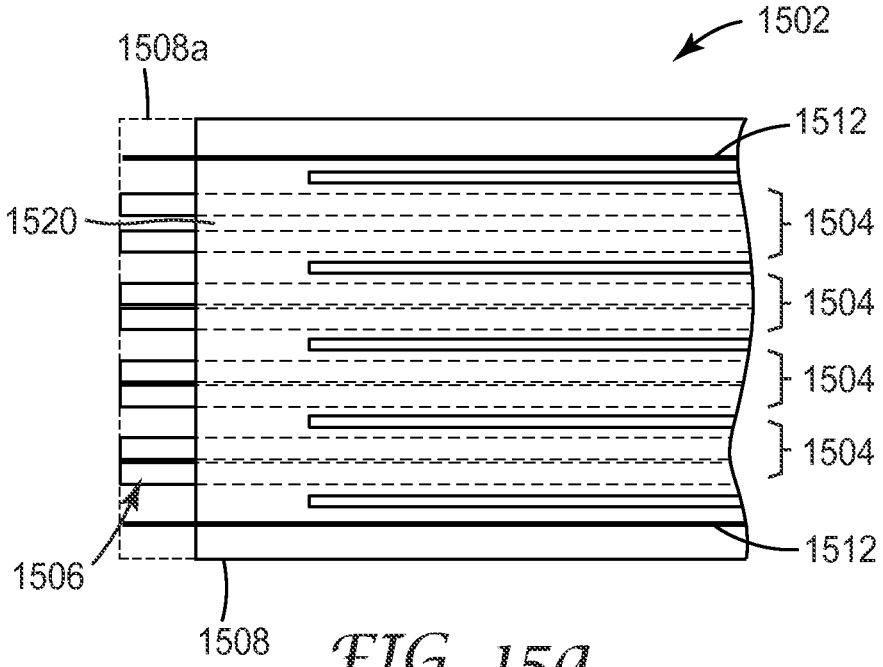
FIGS. 15*a*-15*d* are top views that illustrate different procedures of an exemplary termination process of a shielded electrical cable to a termination component.
Figure 15B:
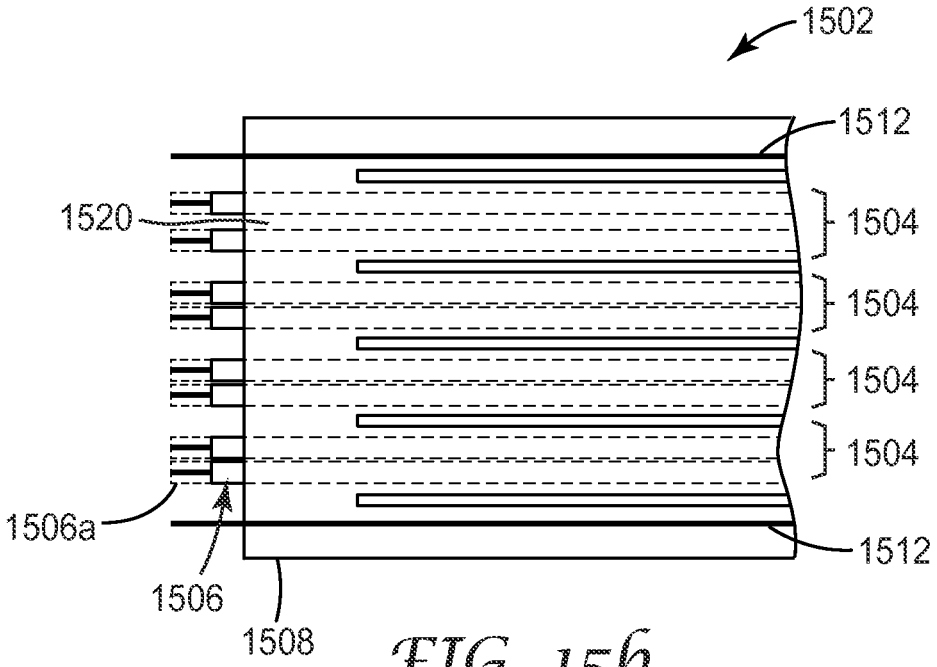
Figure 15C:
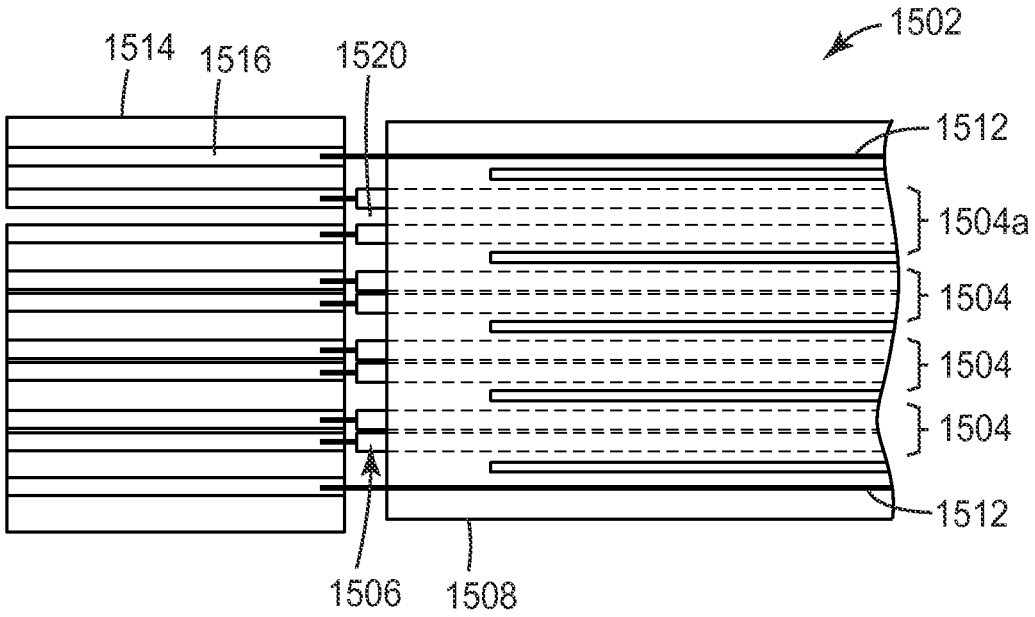
Figure 15D:
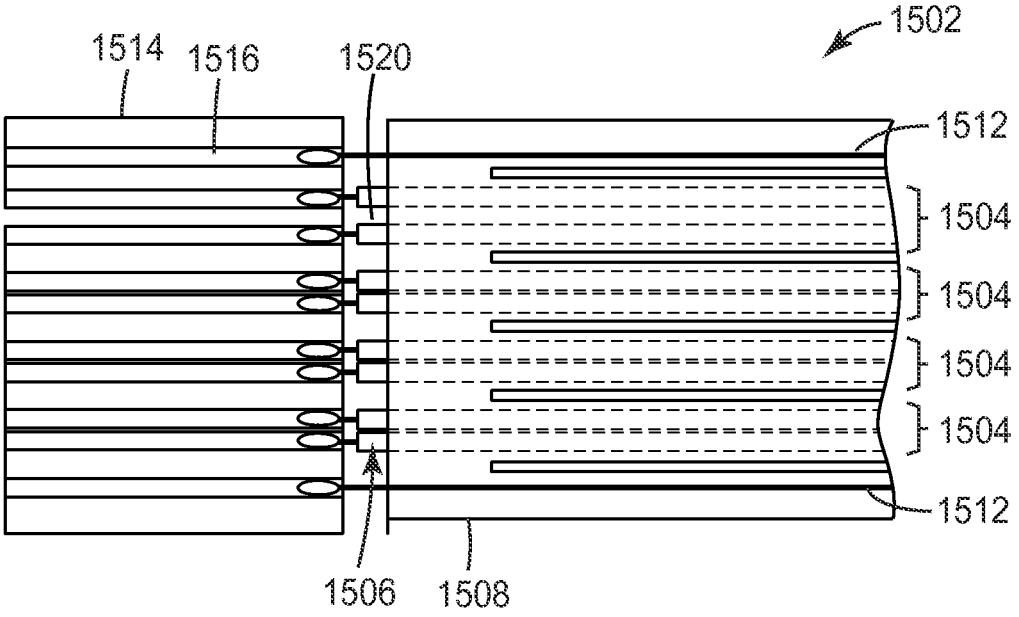

In the step illustrated in FIG. 15*a*, an end portion 1508*a* of shielding films 1508 is removed. Any suitable method may be used, such as, e.g., mechanical stripping or laser stripping. This step exposes an end portion of insulated conductors 1506 and ground conductors 1512. In one aspect, mass-stripping of end portion 1508*a* of shielding films 1508 is possible because they form an integrally connected layer that is separate from the insulation of insulated conductors 1506. Removing shielding films 1508 from insulated conductors 1506 allows protection against electrical shorting at these locations and also provides independent movement of the exposed end portions of insulated conductors 1506 and ground conductors 1512. In the step illustrated in FIG. 15*b*, an end portion 1506*a* of the insulation of insulated conductors 1506 is removed. Any suitable method may be used, such as, e.g., mechanical stripping or laser stripping. This step exposes an end portion of the conductor of insulated conductors 1506. In the step illustrated in FIG. 15*c*, shielded electrical cable 1502 is aligned with printed circuit board 1514 such that the end portions of the conductors of insulated conductors 1506 and the end portions of ground conductors 1512 of shielded electrical cable 1502 are aligned with contact elements 1516 on printed circuit board 1514. In the step illustrated in FIG. 15*d*, the end portions of the conductors of insulated conductors 1506 and the end portions of ground conductors 1512 of shielded electrical cable 1502 are terminated to contact elements 1516 on printed circuit board 1514. Examples of suitable termination methods that may be used include soldering, welding, crimping, mechanical clamping, and adhesively bonding, to name a few.

In some cases, the disclosed shielded cables can be made to include one or more longitudinal slits or other splits disposed between conductor sets. The splits may be used to separate individual conductor sets at least along a portion of the length of shielded cable, thereby increasing at least the lateral flexibility of the cable. This may allow, for example, the shielded cable to be placed more easily into a curvilinear outer jacket. In other embodiments, splits may be placed so as to separate individual or multiple conductor sets and ground conductors. To maintain the spacing of conductor sets and ground conductors, splits may be discontinuous along the length of shielded electrical cable. To maintain the spacing of conductor sets and ground conductors in at least one end portion of a shielded electrical cable so as to maintain mass-termination capability, the splits may not extend into one or both end portions of the cable. The splits may be formed in the shielded electrical cable using any suitable method, such as, e.g., laser cutting or punching. Instead of or in combination with longitudinal splits, other suitable shapes of openings may be formed in the disclosed shielded electrical cables, such as, e.g., holes, e.g., to increase at least the lateral flexibility of the cable.

The shielding films used in the disclosed shielded cables can have a variety of configurations and be made in a variety of ways. In some cases, one or more shielding films may include a conductive layer and a non-conductive polymeric layer. The conductive layer may include any suitable conductive material, including but not limited to copper, silver, aluminum, gold, and alloys thereof. The non-conductive polymeric layer may include any suitable polymeric material, including but not limited to polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, natural rubber, epoxies, and synthetic rubber adhesive. The non-conductive polymeric layer may include one or more additives and/or fillers to provide properties suitable for the intended application. In some cases, at least one of the shielding films may include a laminating adhesive layer disposed between the conductive layer and the non-conductive polymeric layer. For shielding films that have a conductive layer disposed on a non-conductive layer, or that otherwise have one major exterior surface that is electrically conductive and an opposite major exterior surface that is substantially non-conductive, the shielding film may be incorporated into the shielded cable in several different orientations as desired. In some cases, for example, the conductive surface may face the conductor sets of insulated wires and ground wires, and in some cases the non-conductive surface may face those components. In cases where two shielding films are used on opposite sides of the cable, the films may be oriented such that their conductive surfaces face each other and each face the conductor sets and ground wires, or they may be oriented such that their non-conductive surfaces face each other and each face the conductor sets and ground wires, or they may be oriented such that the conductive surface of one shielding film faces the conductor sets and ground wires, while the non-conductive surface of the other shielding film faces conductor sets and ground wires from the other side of the cable.

In some cases, at least one of the shielding films may be or include a stand-alone conductive film, such as a compliant or flexible metal foil. The construction of the shielding films may be selected based on a number of design parameters suitable for the intended application, such as, e.g., flexibility, electrical performance, and configuration of the shielded electrical cable (such as, e.g., presence and location of ground conductors). In some cases, the shielding films may have an integrally formed construction. In some cases, the shielding films may have a thickness in the range of 0.01 mm to 0.05 mm. The shielding films desirably provide isolation, shielding, and precise spacing between the conductor sets, and allow for a more automated and lower cost cable manufacturing process. In addition, the shielding films prevent a phenomenon known as "signal suck-out" or resonance, whereby high signal attenuation occurs at a particular frequency range. This phenomenon typically occurs in conventional shielded electrical cables where a conductive shield is wrapped around a conductor set.

As discussed elsewhere herein, adhesive material may be used in the cable construction to bond one or two shielding films to one, some, or all of the conductor sets at cover regions of the cable, and/or adhesive material may be used to bond two shielding films together at pinched regions of the cable. A layer of adhesive material may be disposed on at least one shielding film, and in cases where two shielding films are used on opposite sides of the cable, a layer of adhesive material may be disposed on both shielding films. In the latter cases, the adhesive used on one shielding film is preferably the same as, but may if desired be different from, the adhesive used on the other shielding film. A given adhesive layer may include an electrically insulative adhesive, and may provide an insulative bond between two shielding films. Furthermore, a given adhesive layer may provide an insulative bond between at least one of shielding films and insulated conductors of one, some, or all of the conductor sets, and between at least one of shielding films and one, some, or all of the ground conductors (if any). Alternatively, a given adhesive layer may include an electrically conductive adhesive, and may provide a conductive bond between two shielding films. Furthermore, a given adhesive layer may provide a conductive bond between at least one of shielding films and one, some, or all of the ground conductors (if any). Suitable conductive adhesives include conductive particles to provide the flow of electrical current. The conductive particles can be any of the types of particles currently used, such as spheres, flakes, rods, cubes, amorphous, or other particle shapes. They may be solid or substantially solid particles such as carbon black, carbon fibers, nickel spheres, nickel coated copper spheres, metal-coated oxides, metal-coated polymer fibers, or other similar conductive particles. These conductive particles can be made from electrically insulating materials that are plated or coated with a conductive material such as silver, aluminum, nickel, or indium tin-oxide. The metal-coated insulating material can be substantially hollow particles such as hollow glass spheres, or may comprise solid materials such as glass beads or metal oxides. The conductive particles may be on the order of several tens of microns to nanometer sized materials such as carbon nanotubes. Suitable conductive adhesives may also include a conductive polymeric matrix.

When used in a given cable construction, an adhesive layer is preferably substantially conformable in shape relative to other elements of the cable, and conformable with regard to bending motions of the cable. In some cases, a given adhesive layer may be substantially continuous, e.g., extending along substantially the entire length and width of a given major surface of a given shielding film. In some cases, the adhesive layer may include be substantially discontinuous. For example, the adhesive layer may be present only in some portions along the length or width of a given shielding film. A discontinuous adhesive layer may for example include a plurality of longitudinal adhesive stripes that are disposed, e.g., between the pinched portions of the shielding films on both sides of each conductor set and between the shielding films beside the ground conductors (if any). A given adhesive material may be or include at least one of a pressure sensitive adhesive, a hot melt adhesive, a thermoset adhesive, and a curable adhesive. An adhesive layer may be configured to provide a bond between shielding films that is substantially stronger than a bond between one or more insulated conductor and the shielding films. This may be achieved, e.g., by appropriate selection of the adhesive formulation. An advantage of this adhesive configuration is to allow the shielding films to be readily strippable from the insulation of insulated conductors. In other cases, an adhesive layer may be configured to provide a bond between shielding films and a bond between one or more insulated conductor and the shielding films that are substantially equally strong. An advantage of this adhesive configuration is that the insulated conductors are anchored between the shielding films. When a shielded electrical cable having this construction is bent, this allows for little relative movement and therefore reduces the likelihood of buckling of the shielding films. Suitable bond strengths may be chosen based on the intended application. In some cases, a conformable adhesive layer may be used that has a thickness of less than about 0.13 mm. In exemplary embodiments, the adhesive layer has a thickness of less than about 0.05 mm.

A given adhesive layer may conform to achieve desired mechanical and electrical performance characteristics of the shielded electrical cable. For example, the adhesive layer may conform to be thinner between the shielding films in areas between conductor sets, which increases at least the lateral flexibility of the shielded cable. This may allow the shielded cable to be placed more easily into a curvilinear outer jacket. In some cases, an adhesive layer may conform to be thicker in areas immediately adjacent the conductor sets and substantially conform to the conductor sets. This may increase the mechanical strength and enable forming a curvilinear shape of shielding films in these areas, which may increase the durability of the shielded cable, for example, during flexing of the cable. In addition, this may help to maintain the position and spacing of the insulated conductors relative to the shielding films along the length of the shielded cable, which may result in more uniform impedance and superior signal integrity of the shielded cable.

A given adhesive layer may conform to effectively be partially or completely removed between the shielding films in areas between conductor sets, e.g., in pinched regions of the cable. As a result, the shielding films may electrically contact each other in these areas, which may increase the electrical performance of the cable. In some cases, an adhesive layer may conform to effectively be partially or completely removed between at least one of the shielding films and the ground conductors. As a result, the ground conductors may electrically contact at least one of shielding films in these areas, which may increase the electrical performance of the cable. Even in cases where a thin layer of adhesive remains between at least one of shielding films and a given ground conductor, asperities on the ground conductor may break through the thin adhesive layer to establish electrical contact as intended.

Figure 16A:
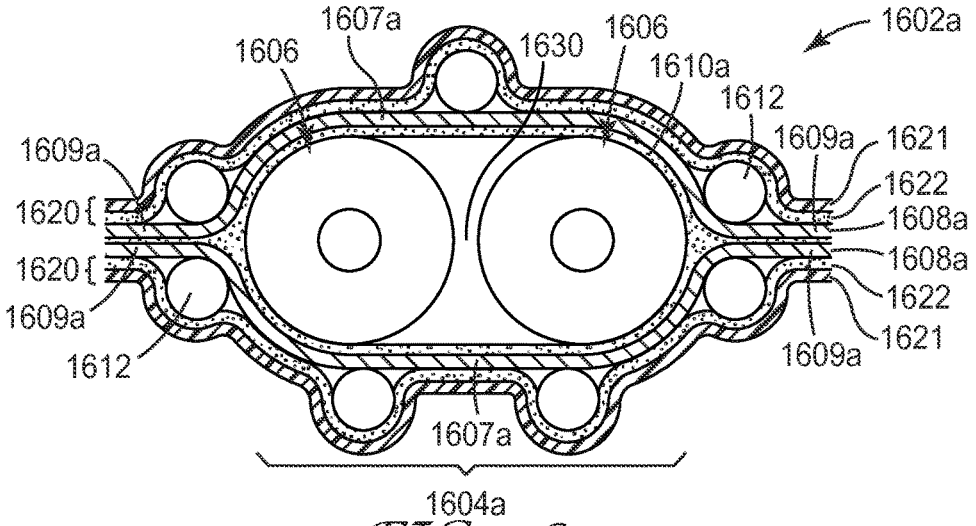
FIGS. 16*a*-16*c* are front cross-sectional views of still further exemplary shielded electrical cables.
Figure 16B:
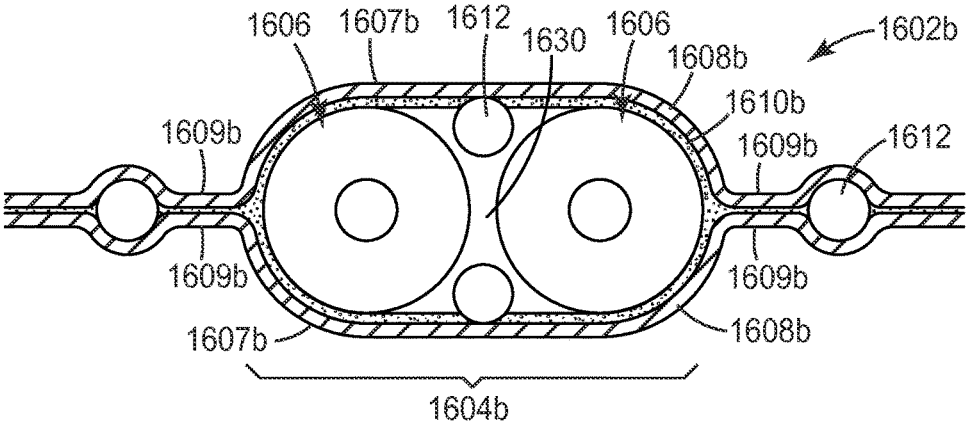
Figure 16C:
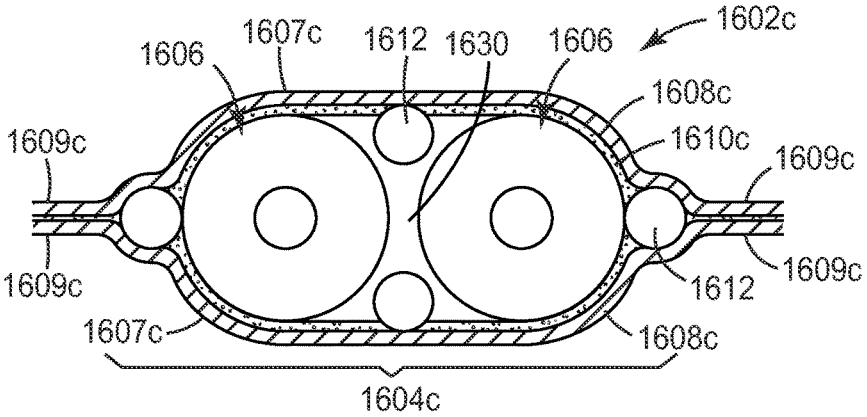

In FIGS. 16*a*-16*c* are cross sectional views of three exemplary shielded electrical cables, which illustrate examples of the placement of ground conductors in the shielded electrical cables. An aspect of a shielded electrical cable is proper grounding of the shield, and such grounding can be accomplished in a number of ways. In some cases, a given ground conductor can electrically contact at least one of the shielding films such that grounding the given ground conductor also grounds the shielding film or films. Such a ground conductor may also be referred to as a "drain wire". Electrical contact between the shielding film and the ground conductor may be characterized by a relatively low DC resistance, e.g., a DC resistance of less than 10 ohms, or less than 2 ohms, or of substantially 0 ohms. In some cases, a given ground conductors may not electrically contact the shielding films, but may be an individual element in the cable construction that is independently terminated to any suitable individual contact element of any suitable termination component, such as, e.g., a conductive path or other contact element on a printed circuit board, paddle board, or other device. Such a ground conductor may also be referred to as a "ground wire". In FIG. 16*a*, an exemplary shielded electrical cable is illustrated in which ground conductors are positioned external to the shielding films. In FIGS. 16*b* and 16*c*, embodiments are illustrated in which the ground conductors are positioned between the shielding films, and may be included in the conductor set. One or more ground conductors may be placed in any suitable position external to the shielding films, between the shielding films, or a combination of both.

Referring to FIG. 16*a*, a shielded electrical cable 1602*a* includes a single conductor set 1604*a* that extends along a length of the cable 1602*a*. Conductor set 1604*a* has two insulated conductors 1606, i.e., one pair of insulated conductors, separated by dielectric gap 1630. Cable 1602*a* may be made to have multiple conductor sets 1604*a* spaced apart from each other across a width of the cable and extending along a length of the cable. Two shielding films 1608*a* disposed on opposite sides of the cable include cover portions 1607*a*. In transverse cross section, the cover portions 1607*a*, in combination, substantially surround conductor set 1604*a*. An optional adhesive layer 1610*a* is disposed between pinched portions 1609*a* of the shielding films 1608*a*, and bonds shielding films 1608*a* to each other on both sides of conductor set 1604*a*. Insulated conductors 1606 are arranged generally in a single plane and effectively in a twinaxial cable configuration that can be used in a single ended circuit arrangement or a differential pair circuit arrangement. The shielded electrical cable 1602*a* further includes a plurality of ground conductors 1612 positioned external to shielding films 1608*a*. Ground conductors 1612 are placed over, under, and on both sides of conductor set 1604*a*. Optionally, the cable 1602*a* includes protective films 1620 surrounding the shielding films 1608*a* and ground conductors 1612. Protective films 1620 include a protective layer 1621 and an adhesive layer 1622 bonding protective layer 1621 to shielding films 1608*a* and ground conductors 1612. Alternatively, shielding films 1608*a* and ground conductors 1612 may be surrounded by an outer conductive shield, such as, e.g., a conductive braid, and an outer insulative jacket (not shown).

Referring to FIG. 16*b*, a shielded electrical cable 1602*b* includes a single conductor set 1604*b* that extends along a length of cable 1602*b*. Conductor set 1604*b* has two insulated conductors 1606, i.e., one pair of insulated conductors, separated by dielectric gap 1630. Cable 1602*b* may be made to have multiple conductor sets 1604*b* spaced apart from each other across a width of the cable and extending along the length of the cable. Two shielding films 1608*b* are disposed on opposite sides of the cable 1602*b* and include cover portions 1607*b*. In transverse cross section, the cover portions 1607*b*, in combination, substantially surround conductor set 1604*b*. An optional adhesive layer 1610*b* is disposed between pinched portions 1609*b* of the shielding films 1608*b* and bonds the shielding films to each other on both sides of the conductor set. Insulated conductors 1606 are arranged generally in a single plane and effectively in a twinaxial or differential pair cable arrangement. Shielded electrical cable 1602*b* further includes a plurality of ground conductors 1612 positioned between shielding films 1608*b*. Two of the ground conductors 1612 are included in conductor set 1604*b*, and two of the ground conductors 1612 are spaced apart from conductor set 1604*b*.

Referring to FIG. 16*c*, a shielded electrical cable 1602*c* includes a single conductor set 1604*c* that extends along a length of cable 1602*c*. Conductor set 1604*c* has two insulated conductors 1606, i.e., one pair of insulated conductors, separated by dielectric gap 1630. Cable 1602*c* may be made to have multiple conductor sets 1604*c* spaced apart from each other across a width of the cable and extending along the length of the cable. Two shielding films 1608*c* are disposed on opposite sides of the cable 1602*c* and include cover portions 1607*c*. In transverse cross section, the cover portions 1607*c*, in combination, substantially surround the conductor set 1604*c*. An optional adhesive layer 1610*c* is disposed between pinched portions 1609*c* of the shielding films 1608*c* and bonds shielding films 1608*c* to each other on both sides of conductor set 1604*c*. Insulated conductors 1606 are arranged generally in a single plane and effectively in a twinaxial or differential pair cable arrangement. Shielded electrical cable 1602*c* further includes a plurality of ground conductors 1612 positioned between shielding films 1608*c*. All of the ground conductors 1612 are included in the conductor set 1604*c*. Two of the ground conductors 1612 and insulated conductors 1606 are arranged generally in a single plane.

The disclosed shielded cables can, if desired, be connected to a circuit board or other termination component using one or more electrically conductive cable clips. For example, a shielded electrical cable may include a plurality of spaced apart conductor sets arranged generally in a single plane, and each conductor set may include two insulated conductors that extend along a length of the cable. Two shielding films may be disposed on opposite sides of the cable and, in transverse cross section, substantially surround each of the conductor sets. A cable clip may be clamped or otherwise attached to an end portion of the shielded electrical cable such that at least one of shielding films electrically contacts the cable clip. The cable clip may be configured for termination to a ground reference, such as, e.g., a conductive trace or other contact element on a printed circuit board, to establish a ground connection between shielded electrical cable and the ground reference. The cable clip may be terminated to the ground reference using any suitable method, including soldering, welding, crimping, mechanical clamping, and adhesively bonding, to name a few. When terminated, the cable clip may facilitate termination of end portions of the conductors of the insulated conductors of the shielded electrical cable to contact elements of a termination point, such as, e.g., contact elements on printed circuit board. The shielded electrical cable may include one or more ground conductors as described herein that may electrically contact the cable clip in addition to or instead of at least one of the shielding films.

Figure 5A:
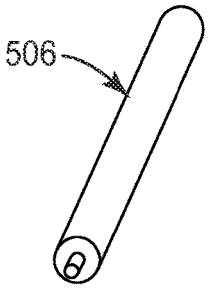
FIGS. 5*a*-5*c* are perspective views illustrating an exemplary method of making a shielded electrical cable.
Figure 5B:
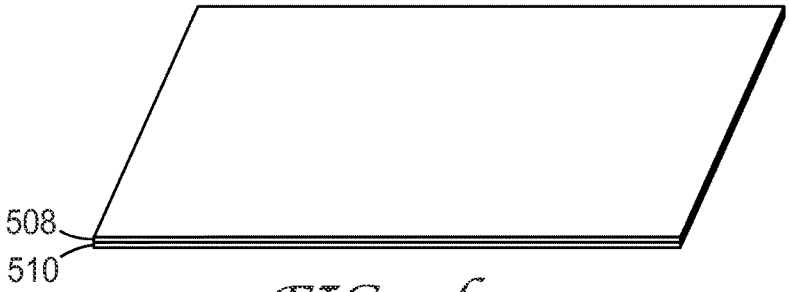
Figure 5C:
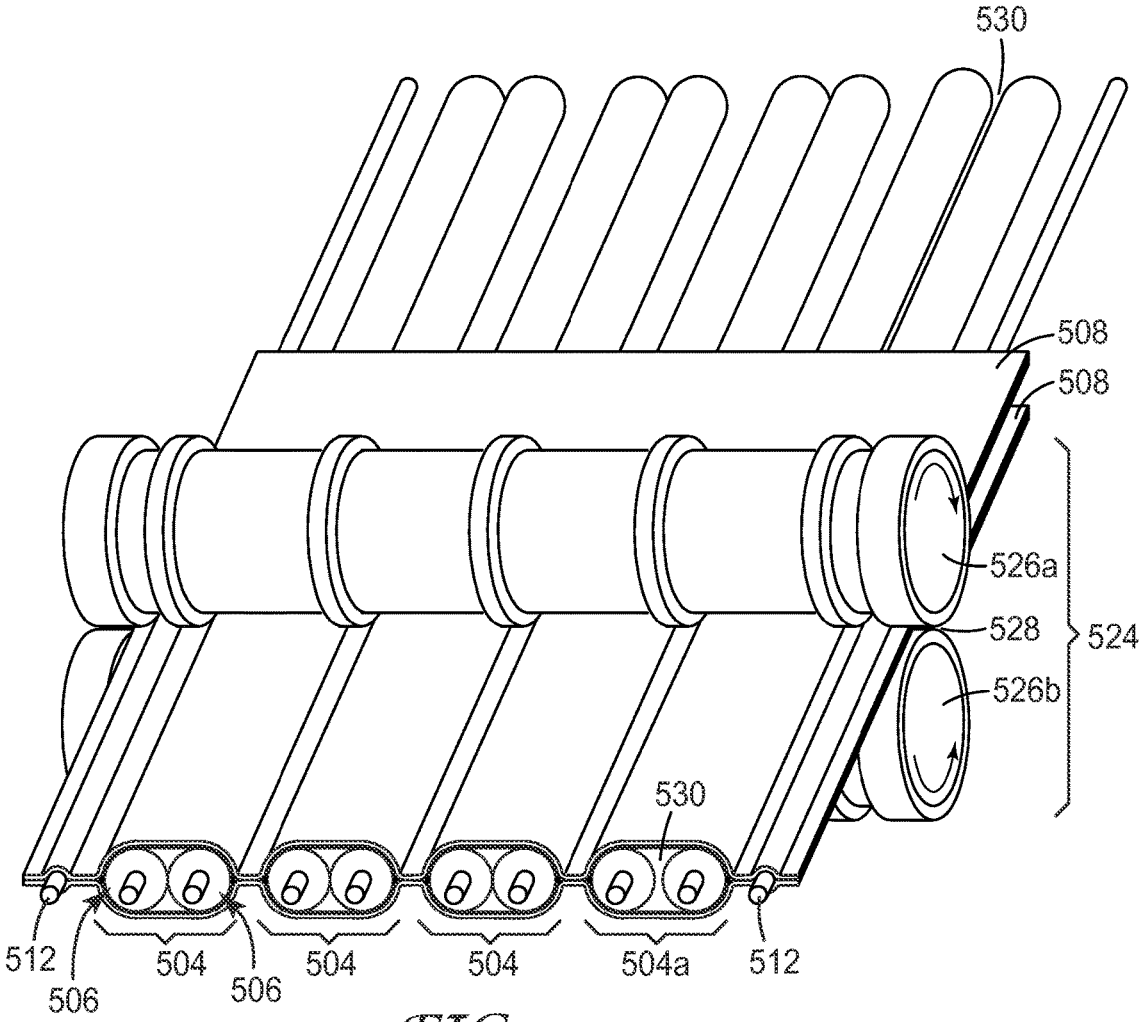

In FIGS. 5*a*-5*c*, exemplary methods of making a shielded electrical cable are illustrated. Specifically, these figures illustrate an exemplary method of making a shielded electrical cable that may have features of cables previously shown. In the step illustrated in FIG. 5*a*, insulated conductors 506 are formed using any suitable method, such as, e.g., extrusion, or are otherwise provided. Insulated conductors 506 may be formed of any suitable length. Insulated conductors 506 may then be provided as such or cut to a desired length. Ground conductors 512 (see FIG. 5*c*) may be formed and provided in a similar fashion.

In the step illustrated in FIG. 5*b*, shielding films 508 are formed. A single layer or multilayer web may be formed using any suitable method, such as, e.g., continuous wide web processing. Shielding films 508 may be formed of any suitable length. Shielding films 508 may then be provided as such or cut to a desired length and/or width. Shielding films 508 may be pre-formed to have transverse partial folds to increase flexibility in the longitudinal direction. One or both of the shielding films may include a conformable adhesive layer 510, which may be formed on the shielding films 508 using any suitable method, such as, e.g., laminating or sputtering.

In the step illustrated in FIG. 5*c*, a plurality of insulated conductors 506, ground conductors 512, and shielding films 508 are provided. A forming tool 524 is provided. Forming tool 524 includes a pair of forming rolls 526*a*, 526*b* having a shape corresponding to a desired cross-sectional shape of the finished shielded electrical cable (which may include provisions for forming dielectric/gap 530), the forming tool also including a bite 528. Insulated conductors 506, ground conductors 512, and shielding films 508 are arranged according to the configuration of the desired shielded cable, such as any of the cables shown and/or described herein, and positioned in proximity to forming rolls 526*a*, 526*b*, after which they are concurrently fed into bite 528 of forming rolls 526*a*, 526*b* and disposed between forming rolls 526*a*, 526*b*. The forming tool 524 forms shielding films 508 around conductor sets 504, 504*a* (the latter having dielectric/gap 530) and ground conductor 512 and bonds shielding films 508 to each other on both sides of each conductor set 504 and ground conductors 512. Heat may be applied to facilitate bonding. Although in this embodiment, forming shielding films 508 around conductor sets 504 and ground conductor 512 and bonding shielding films 508 to each other on both sides of each conductor set 504 and ground conductors 512 occur in a single operation, in other embodiments, these steps may occur in separate operations.

In subsequent fabrication operations, longitudinal splits may if desired be formed between the conductor sets. Such splits may be formed in the shielded cable using any suitable method, such as, e.g., laser cutting or punching. In another optional fabrication operation, the shielded electrical cable may be folded lengthwise along the pinched regions multiple times into a bundle, and an outer conductive shield may be provided around the folded bundle using any suitable method. An outer jacket may also be provided around the outer conductive shield using any suitable method, such as, e.g., extrusion. In other embodiments, the outer conductive shield may be omitted and the outer jacket may be provided by itself around the folded shielded cable.

Figure 6A:
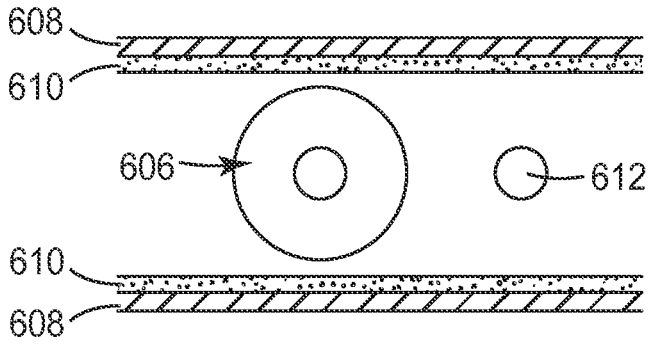
FIGS. 6*a*-6*c* are front cross-sectional views illustrating a detail of an exemplary method of making a shielded electrical cable.
Figure 6B:
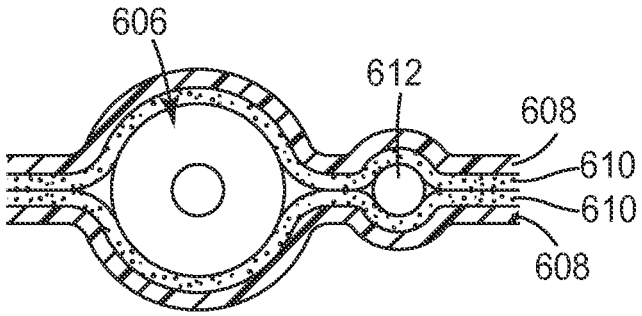
Figure 6C:
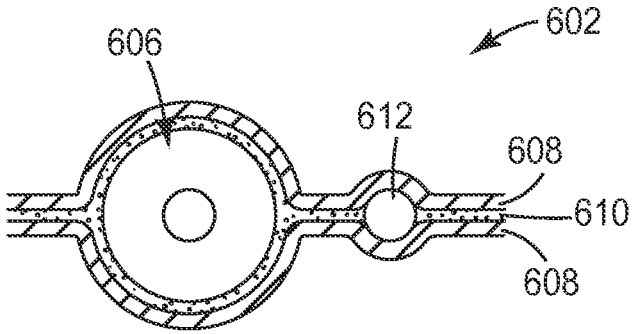

In FIGS. 6*a*-6*c*, details are illustrated of an exemplary method of making a shielded electrical cable. In particular, these figures illustrate how one or more adhesive layers may be conformably shaped during the forming and bonding of the shielding films.

In the step illustrated in FIG. 6*a*, an insulated conductor 606, a ground conductor 612 spaced apart from the insulated conductor 606, and two shielding films 608 are provided. Shielding films 608 each include a conformable adhesive layer 610. In the steps illustrated in FIGS. 6*b*-6*c*, shielding films 608 are formed around insulated conductor 606 and ground conductor 612 and bonded to each other. Initially, as illustrated in FIG. 6*b*, the adhesive layers 610 still have their original thickness. As the forming and bonding of shielding films 608 proceeds, the adhesive layers 610 conform to achieve desired mechanical and electrical performance characteristics of finished shielded electrical cable 602 (FIG. 6*c*).

As illustrated in FIG. 6*c*, adhesive layers 610 conform to be thinner between shielding films 608 on both sides of insulated conductor 606 and ground conductor 612; a portion of adhesive layers 610 displaces away from these areas. Further, adhesive layers 610 conform to be thicker in areas immediately adjacent insulated conductor 606 and ground conductor 612, and substantially conform to insulated conductor 606 and ground conductor 612; a portion of adhesive layers 610 displaces into these areas. Further, adhesive layers 610 conform to effectively be removed between shielding films 608 and ground conductor 612; the adhesive layers 610 displace away from these areas such that ground conductor 612 electrically contacts shielding films 608.

Figure 7A:
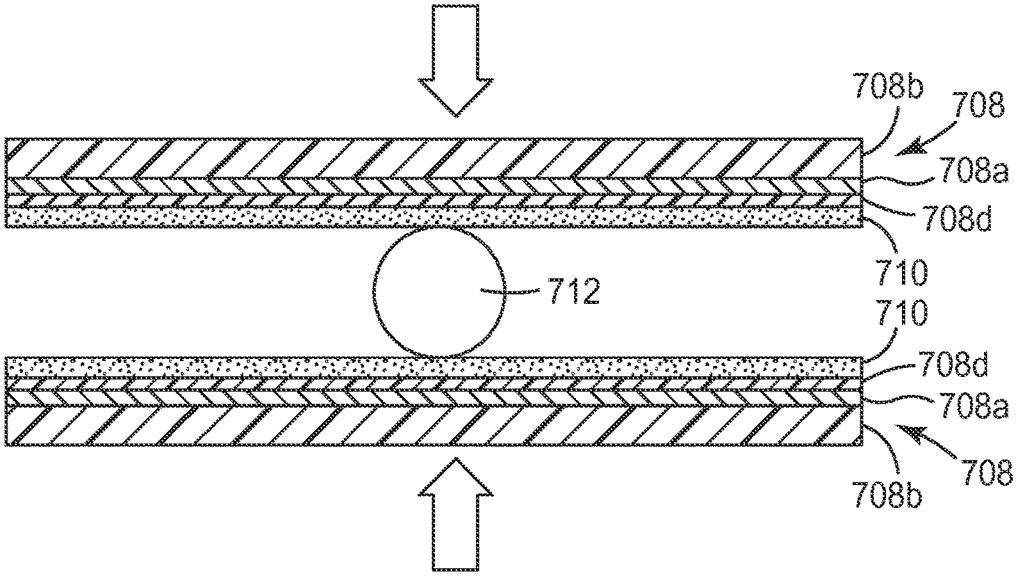
FIGS. 7*a* and 7*b* are front cross-sectional detail views illustrating another aspect of making an exemplary shielded electrical cable.
Figure 7B:
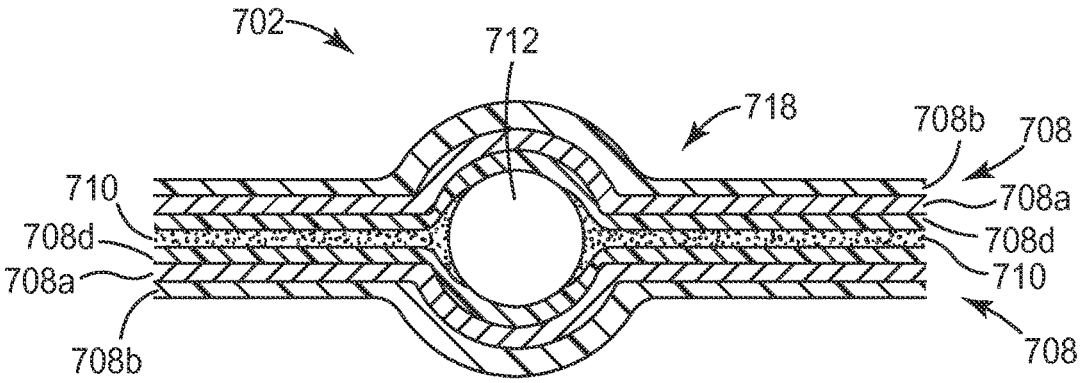

In FIGS. 7*a* and 7*b*, details are shown pertaining to a pinched region during the manufacture of an exemplary shielded electrical cable. Shielded electrical cable 702 (see FIG. 7*b*) is made using two shielding films 708 and includes a pinched region 718 (see FIG. 7*b*) wherein shielding films 708 may be substantially parallel. Shielding films 708 include a non-conductive polymeric layer 708*b*, a conductive layer 708*a* disposed on non-conductive polymeric layer 708*b*, and a stop layer 708*d* disposed on the conductive layer 708*a*. A conformable adhesive layer 710 is disposed on stop layer 708*d*. Pinched region 718 includes a longitudinal ground conductor 712 disposed between shielding films 708. After the shielding films are forced together around the ground conductor, the ground conductor 712 makes indirect electrical contact with the conductive layers 708*a* of shielding films 708. This indirect electrical contact is enabled by a controlled separation of conductive layer 708*a* and ground conductor 712 provided by stop layer 708*d*. In some cases, the stop layer 708*d* may be or include a non-conductive polymeric layer. As shown in the figures, an external pressure (see FIG. 7*a*) is used to press conductive layers 708*a* together and force the adhesive layers 710 to conform around the ground conductor 712 (FIG. 7*b*). Because the stop layer 708*d* does not conform at least under the same processing conditions, it prevents direct electrical contact between the ground conductor 712 and conductive layer 708*a* of the shielding films 708, but achieves indirect electrical contact. The thickness and dielectric properties of stop layer 708*d* may be selected to achieve a low target DC resistance, i.e., electrical contact of an indirect type. In some embodiments, the characteristic DC resistance between the ground conductor and the shielding film may be less than 10 ohms, or less than 5 ohms, for example, but greater than 0 ohms, to achieve the desired indirect electrical contact. In some cases, it is desirable to make direct electrical contact between a given ground conductor and one or two shielding films, whereupon the DC resistance between such ground conductor and such shielding film(s) may be substantially 0 ohms.

In exemplary embodiments, the cover regions of the shielded electrical cable include concentric regions and transition regions positioned on one or both sides of a given conductor set. Portions of a given shielding film in the concentric regions are referred to as concentric portions of the shielding film, and portions of the shielding film in the transition regions are referred to as transition portions of the shielding film. The transition regions can be configured to provide high manufacturability and strain and stress relief of the shielded electrical cable. Maintaining the transition regions at a substantially constant configuration (including aspects such as, e.g., size, shape, content, and radius of curvature) along the length of the shielded electrical cable may help the shielded electrical cable to have substantially uniform electrical properties, such as, e.g., high frequency isolation, impedance, skew, insertion loss, reflection, mode conversion, eye opening, and jitter.

Additionally, in certain embodiments, such as, e.g., embodiments wherein the conductor set includes two insulated conductors that extend along a length of the cable that are arranged generally in a single and effectively as a twinaxial cable that can be connected in a differential pair circuit arrangement, maintaining the transition portion at a substantially constant configuration along the length of the shielded electrical cable can beneficially provide substantially the same electromagnetic field deviation from an ideal concentric case for both conductors in the conductor set. Thus, careful control of the configuration of this transition portion along the length of the shielded electrical cable can contribute to the advantageous electrical performance and characteristics of the cable. FIGS. 8*a* through 10 illustrate various exemplary embodiments of a shielded electrical cable that include transition regions of the shielding films disposed on one or both sides of the conductor set.

Figure 8A:
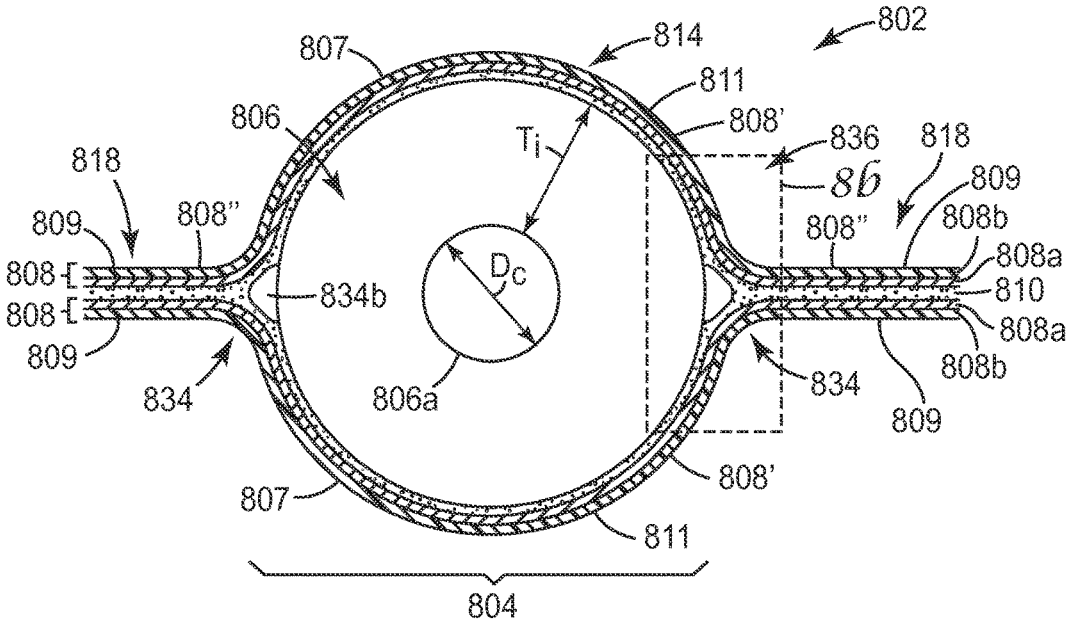
FIG. 8*a* is a front cross-sectional view of another exemplary embodiment of a shielded electrical cable.
Figure 8B:
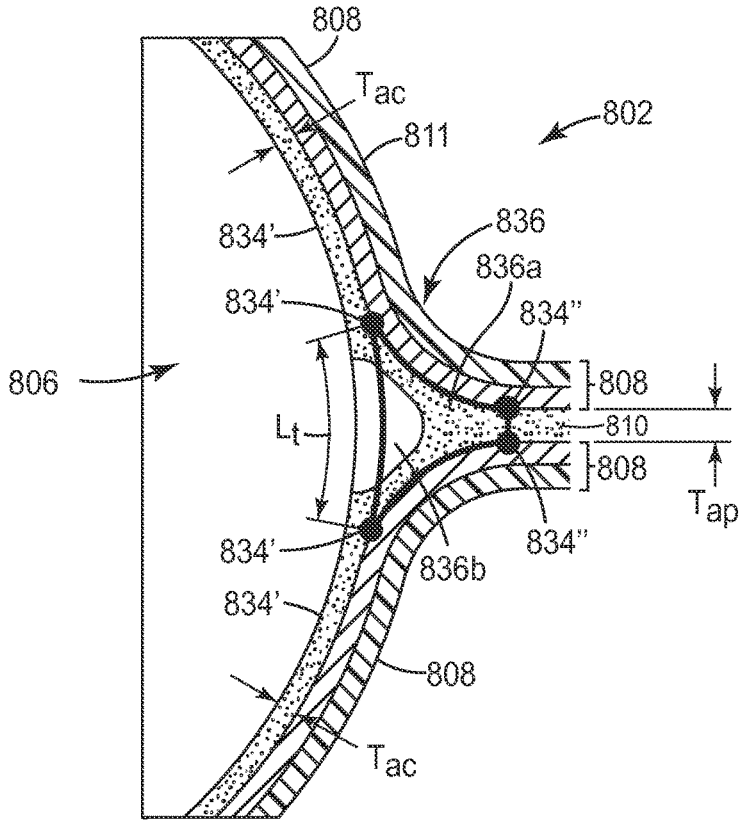
FIG. 8*b* is a corresponding detail view thereof.

The shielded electrical cable 802, which is shown in cross section in FIGS. 8*a* and 8*b*, includes a single conductor set 804 that extends along a length of the cable. The cable 802 may be made to have multiple conductor sets 804 spaced apart from each other along a width of the cable and extending along a length of the cable. Although only one insulated conductor 806 is shown in FIG. 8*a*, multiple insulated conductors may be included in the conductor set 804 if desired, and may further include a dielectric/air gap separating the multiple insulated conductors.

The insulated conductor of a conductor set that is positioned nearest to a pinched region of the cable is considered to be an end conductor of the conductor set. The conductor set 804, as shown, has a single insulated conductor 806, and it is also an end conductor since it is positioned nearest to the pinched region 818 of the shielded electrical cable 802.

First and second shielding films 808 are disposed on opposite sides of the cable and include cover portions 807. In transverse cross section, the cover portions 807 substantially surround conductor set 804. An optional adhesive layer 810 is disposed between the pinched portions 809 of the shielding films 808, and bonds shielding films 808 to each other in the pinched regions 818 of the cable 802 on both sides of conductor set 804. The optional adhesive layer 810 may extend partially or fully across the cover portion 807 of the shielding films 808, e.g., from the pinched portion 809 of the shielding film 808 on one side of the conductor set 804 to the pinched portion 809 of the shielding film 808 on the other side of the conductor set 804.

Insulated conductor 806 is effectively arranged as a coaxial cable which may be used in a single ended circuit arrangement. Shielding films 808 may include a conductive layer 808*a* and a non-conductive polymeric layer 808*b*. In some embodiments, as illustrated by FIGS. 8*a* and 8*b*, the conductive layer 808*a* of both shielding films faces the insulated conductors. Alternatively, the orientation of the conductive layers of one or both of shielding films 808 may be reversed, as discussed elsewhere herein.

Shielding films 808 include a concentric portion that is substantially concentric with the end conductor 806 of the conductor set 804. The shielded electrical cable 802 includes transition regions 836. Portions of the shielding film 808 in the transition region 836 of the cable 802 are transition portions 834 of the shielding films 808. In some embodiments, shielded electrical cable 802 includes a transition region 836 positioned on both sides of the conductor set 804, and in some embodiments a transition region 836 may be positioned on only one side of conductor set 804.

Transition regions 836 are defined by shielding films 808 and conductor set 804. The transition portions 834 of the shielding films 808 in the transition regions 836 provide a gradual transition between concentric portions 811 and pinched portions 809 of the shielding films 808. As opposed to a sharp transition, such as, e.g., a right-angle transition or a transition point (as opposed to a transition portion), a gradual or smooth transition, such as, e.g., a substantially sigmoidal transition, provides strain and stress relief for shielding films 808 in transition regions 836 and prevents damage to shielding films 808 when shielded electrical cable 802 is in use, e.g., when laterally or axially bending shielded electrical cable 802. This damage may include, e.g., fractures in conductive layer 808*a* and/or debonding between conductive layer 808*a* and non-conductive polymeric layer 808*b*. In addition, a gradual transition prevents damage to shielding films 808 in manufacturing of shielded electrical cable 802, which may include, e.g., cracking or shearing of conductive layer 808*a* and/or non-conductive polymeric layer 808*b*. Use of the disclosed transition regions on one or both sides of one, some, or all of the conductor sets in a shielded electrical ribbon cable represents a departure from conventional cable configurations, such as, e.g., a typical coaxial cable, wherein a shield is generally continuously disposed around a single insulated conductor, or a typical conventional twinaxial cable in which a shield is continuously disposed around a pair of insulated conductors. Although these conventional shielding configurations may provide model electromagnetic profiles, such profiles may not be necessary to achieve acceptable electrical properties in a given application.

According to one aspect of at least some of the disclosed shielded electrical cables, acceptable electrical properties can be achieved by reducing the electrical impact of the transition region, e.g., by reducing the size of the transition region and/or carefully controlling the configuration of the transition region along the length of the shielded electrical cable. Reducing the size of the transition region reduces the capacitance deviation and reduces the required space between multiple conductor sets, thereby reducing the conductor set pitch and/or increasing the electrical isolation between conductor sets. Careful control of the configuration of the transition region along the length of the shielded electrical cable contributes to obtaining predictable electrical behavior and consistency, which provides for high speed transmission lines so that electrical data can be more reliably transmitted. Careful control of the configuration of the transition region along the length of the shielded electrical cable is a factor as the size of the transition portion approaches a lower size limit.

An electrical characteristic that is often considered is the characteristic impedance of the transmission line. Any impedance changes along the length of a transmission line may cause power to be reflected back to the source instead of being transmitted to the target. Ideally, the transmission line will have no impedance variation along its length, but, depending on the intended application, variations up to 5-10% may be acceptable. Another electrical characteristic that is often considered in twinaxial cables (differentially driven) is skew or unequal transmission speeds of two transmission lines of a pair along at least a portion of their length. Skew produces conversion of the differential signal to a common mode signal that can be reflected back to the source, reduces the transmitted signal strength, creates electromagnetic radiation, and can dramatically increase the bit error rate, in particular jitter. Ideally, a pair of transmission lines will have no skew, but, depending on the intended application, a differential S-parameter SCD21 or SCD12 value (representing the differential-to common mode conversion from one end of the transmission line to the other) of less than −25 to −30 dB up to a frequency of interest, such as, e.g., 6 GHz, may be acceptable. Alternatively, skew can be measured in the time domain and compared to a required specification. Depending on the intended application, values of less than about 20 picoseconds/meter (ps/m) and preferably less than about 10 ps/m may be acceptable.

Referring again to FIGS. 8*a* and 8*b*, in part to help achieve acceptable electrical properties, transition regions 836 of shielded electrical cable 802 may each include a cross-sectional transition area 836*a*. The transition area 836*a* is preferably smaller than a cross-sectional area 806*a* of conductor 806. As best shown in FIG. 8*b*, cross-sectional transition area 836*a* of transition region 836 is defined by transition points 834' and 834".

The transition points 834' occur where the shielding films deviate from being substantially concentric with the end insulated conductor 806 of the conductor set 804. The transition points 834' are the points of inflection of the shielding films 808 at which the curvature of the shielding films 808 changes sign. For example, with reference to FIG. 8*b*, the curvature of the upper shielding film 808 transitions from concave downward to concave upward at the inflection point which is the upper transition point 834' in the figure. The curvature of the lower shielding film 808 transitions from concave upward to concave downward at the inflection point which is the lower transition point 834' in the figure. The other transition points 834" occur where a separation between the pinched portions 809 of the shielding films 808 exceeds the minimum separation d1 of the pinched portions 809 by a predetermined factor, e.g., 1.5, 2, etc.

In addition, each transition area 836*a* may include a void area 836*b*. Void areas 836*b* on either side of the conductor set 804 may be substantially the same. Further, adhesive layer 810 may have a thickness Tac at the concentric portion 811 of the shielding film 808, and a thickness at the transition portion 834 of the shielding film 808 that is greater than thickness Tac. Similarly, adhesive layer 810 may have a thickness Tap between the pinched portions 809 of the shielding films 808, and a thickness at the transition portion 834 of the shielding film 808 that is greater than thickness Tap. Adhesive layer 810 may represent at least 25% of cross-sectional transition area 836*a*. The presence of adhesive layer 810 in transition area 836*a*, in particular at a thickness that is greater than thickness Tac or thickness Tap, contributes to the strength of the cable 802 in the transition region 836.

Careful control of the manufacturing process and the material characteristics of the various elements of shielded electrical cable 802 may reduce variations in void area 836*b* and the thickness of conformable adhesive layer 810 in transition region 836, which may in turn reduce variations in the capacitance of cross-sectional transition area 836*a*. Shielded electrical cable 802 may include transition region 836 positioned on one or both sides of conductor set 804 that includes a cross-sectional transition area 836*a* that is substantially equal to or smaller than a cross-sectional area 806*a* of conductor 806. Shielded electrical cable 802 may include a transition region 836 positioned on one or both sides of conductor set 804 that includes a cross-sectional transition area 836*a* that is substantially the same along the length of conductor 806. For example, cross-sectional transition area 836*a* may vary less than 50% over a length of 1 meter. Shielded electrical cable 802 may include transition regions 836 positioned on both sides of conductor set 804 that each include a cross-sectional transition area, wherein the sum of cross-sectional areas 834*a* is substantially the same along the length of conductor 806. For example, the sum of cross-sectional areas 834*a* may vary less than 50% over a length of 1 m. Shielded electrical cable 802 may include transition regions 836 positioned on both sides of conductor set 804 that each include a cross-sectional transition area 836*a*, wherein the cross-sectional transition areas 836*a* are substantially the same. Shielded electrical cable 802 may include transition regions 836 positioned on both sides of conductor set 804, wherein the transition regions 836 are substantially identical. Insulated conductor 806 has an insulation thickness Ti, and transition region 836 may have a lateral length Lt that is less than insulation thickness Ti. The central conductor of insulated conductor 806 has a diameter Dc, and transition region 836 may have a lateral length Lt that is less than the diameter Dc. The various configurations described above may provide a characteristic impedance that remains within a desired range, such as, e.g., within 5-10% of a target impedance value, such as, e.g., 50 Ohms, over a given length, such as, e.g., 1 meter.

Factors that can influence the configuration of transition region 836 along the length of shielded electrical cable 802 include the manufacturing process, the thickness of conductive layers 808*a* and non-conductive polymeric layers 808*b*, adhesive layer 810, and the bond strength between insulated conductor 806 and shielding films 808, to name a few. In one aspect, conductor set 804, shielding films 808, and transition region 836 may be cooperatively configured in an impedance controlling relationship. An impedance controlling relationship means that conductor set 804, shielding films 808, and transition region 836 are cooperatively configured to control the characteristic impedance of the shielded electrical cable.

Figure 9:
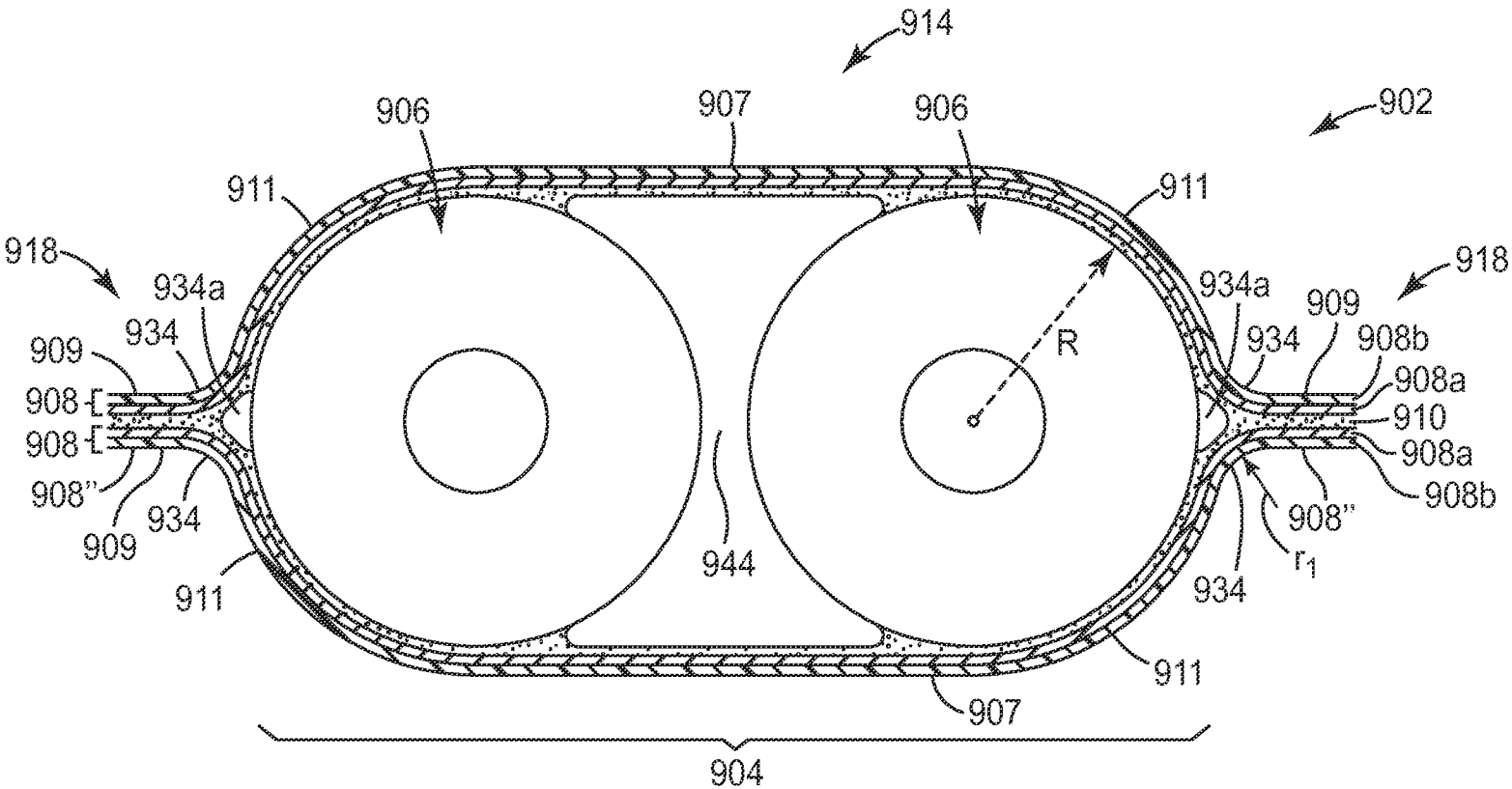
FIG. 9 is a front cross-sectional view of a portion of another exemplary shielded electrical cable.

In FIG. 9, an exemplary shielded electrical cable 902 is shown in transverse cross section that includes two insulated conductors in a connector set 904, the individually insulated conductors 906 each extending along a length of the cable 902 and separated by dielectric/air gap 944. Two shielding films 908 are disposed on opposite sides of the cable 902 and in combination substantially surround conductor set 904. An optional adhesive layer 910 is disposed between pinched portions 909 of the shielding films 908 and bonds shielding films 908 to each other on both sides of conductor set 904 in the pinched regions 918 of the cable. Insulated conductors 906 can be arranged generally in a single plane and effectively in a twinaxial cable configuration. The twinaxial cable configuration can be used in a differential pair circuit arrangement or in a single ended circuit arrangement. Shielding films 908 may include a conductive layer 908*a* and a non-conductive polymeric layer 908*b*, or may include the conductive layer 908*a* without the non-conductive polymeric layer 908*b*. In the figure, the conductive layer 908*a* of each shielding film is shown facing insulated conductors 906, but in alternative embodiments, one or both of the shielding films may have a reversed orientation.

The cover portion 907 of at least one of the shielding films 908 includes concentric portions 911 that are substantially concentric with corresponding end conductors 906 of the conductor set 904. In the transition regions of the cable 902, transition portion 934 of the shielding films 908 are between the concentric portions 911 and the pinched portions 909 of the shielding films 908. Transition portions 934 are positioned on both sides of conductor set 904, and each such portion includes a cross-sectional transition area 934*a*. The sum of cross-sectional transition areas 934*a* is preferably substantially the same along the length of conductors 906. For example, the sum of cross-sectional areas 934*a* may vary less than 50% over a length of 1 m.

In addition, the two cross-sectional transition areas 934*a* may be substantially the same and/or substantially identical. This configuration of transition regions contributes to a characteristic impedance for each conductor 906 (single-ended) and a differential impedance that both remain within a desired range, such as, e.g., within 5-10% of a target impedance value over a given length, such as, e.g., 1 m. In addition, this configuration of the transition regions may minimize skew of the two conductors 906 along at least a portion of their length.

When the cable is in an unfolded, planar configuration, each of the shielding films may be characterizable in transverse cross section by a radius of curvature that changes across a width of the cable 902. The maximum radius of curvature of the shielding film 908 may occur, for example, at the pinched portion 909 of the cable 902, or near the center point of the cover portion 907 of the multi-conductor cable set 904 illustrated in FIG. 9. At these positions, the film may be substantially flat and the radius of curvature may be substantially infinite. The minimum radius of curvature of the shielding film 908 may occur, for example, at the transition portion 934 of the shielding film 908. In some embodiments, the radius of curvature of the shielding film across the width of the cable is at least about 50 micrometers, i.e., the radius of curvature does not have a magnitude smaller than 50 micrometers at any point along the width of the cable, between the edges of the cable. In some embodiments, for shielding films that include a transition portion, the radius of curvature of the transition portion of the shielding film is similarly at least about 50 micrometers.

In an unfolded, planar configuration, shielding films that include a concentric portion and a transition portion are characterizable by a radius of curvature of the concentric portion, R1, and/or a radius of curvature of the transition portion r1. These parameters are illustrated in FIG. 9 for the cable 902. In exemplary embodiments, R1/r1 is in a range of 2 to 15.

Figure 10:
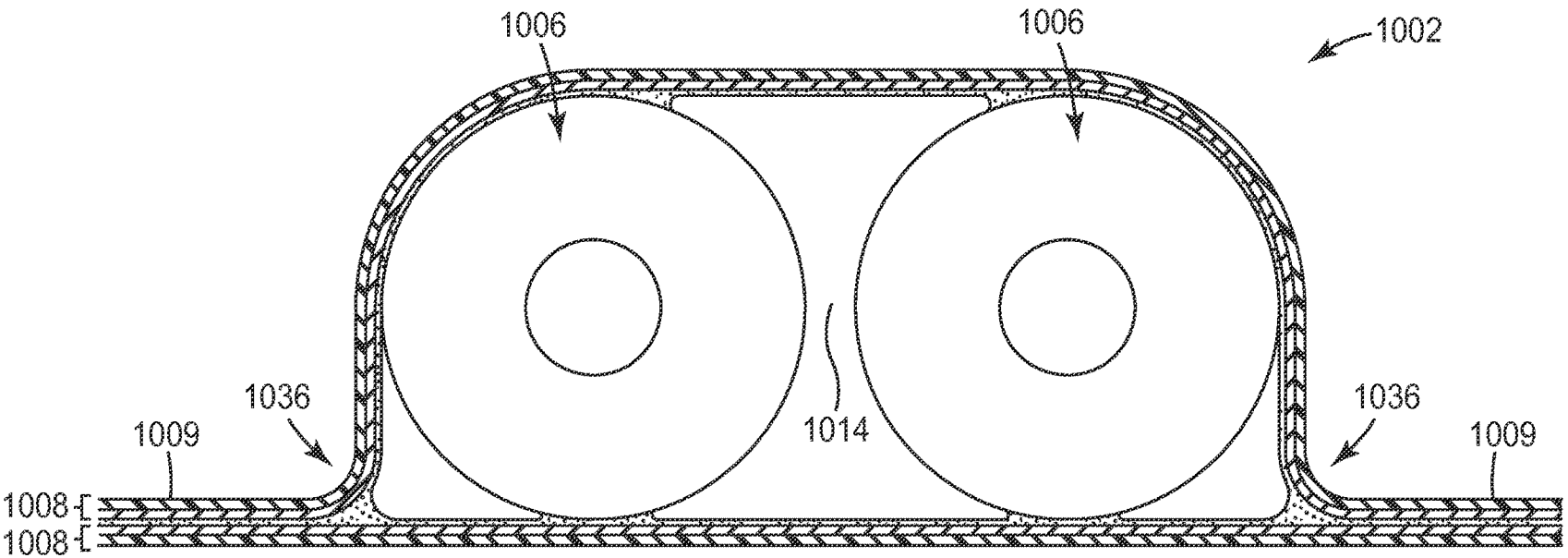
FIG. 10 is a front cross-sectional view of a portion of another exemplary shielded electrical cable.

In FIG. 10 another exemplary shielded electrical cable 1002 is shown which includes a conductor set having two insulated conductors 1006 separated by dielectric/air gap 1014. In this embodiment, the shielding films 1008 have an asymmetric configuration, which changes the position of the transition portions relative to a more symmetric embodiment such as that of FIG. 9. In FIG. 10, shielded electrical cable 1002 has pinched portions 1009 of shielding films 1008 that lie in a plane that is slightly offset from the plane of symmetry of the insulated conductors 1006. As a result, the transition regions 1036 have a somewhat offset position and configuration relative to other depicted embodiments. However, by ensuring that the two transition regions 1036 are positioned substantially symmetrically with respect to corresponding insulated conductors 1006 (e.g. with respect to a vertical plane between the conductors 1006), and that the configuration of transition regions 1036 is carefully controlled along the length of shielded electrical cable 1002, the shielded electrical cable 1002 can be configured to still provide acceptable electrical properties.

Figure 11:
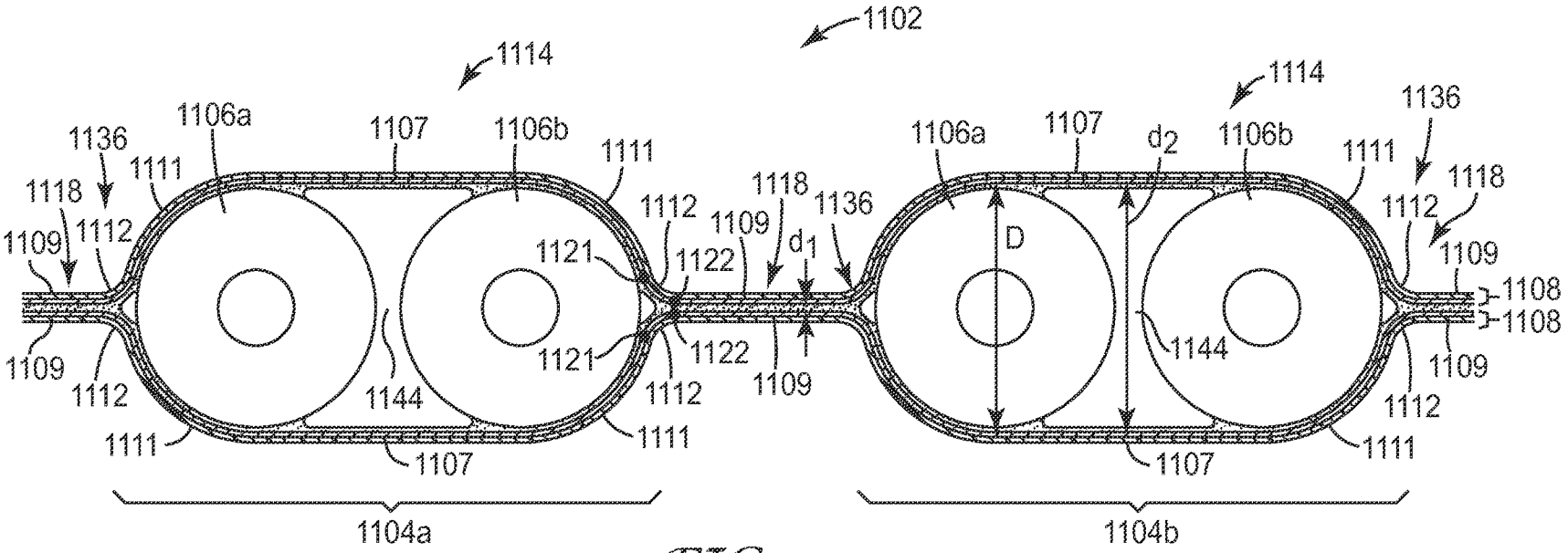
FIG. 11 is a front cross-sectional views of other portions of exemplary shielded electrical cables.

In FIG. 11, additional exemplary shielded electrical cables are illustrated. These figures are used to further explain how a pinched portion of the cable is configured to electrically isolate a conductor set of the shielded electrical cable. The conductor set may be electrically isolated from an adjacent conductor set (e.g., to minimize crosstalk between adjacent conductor sets) or from the external environment of the shielded electrical cable (e.g., to minimize electromagnetic radiation escape from the shielded electrical cable and minimize electromagnetic interference from external sources). In both cases, the pinched portion may include various mechanical structures to realize the electrical isolation. Examples include close proximity of the shielding films, high dielectric constant material between the shielding films, ground conductors that make direct or indirect electrical contact with at least one of the shielding films, extended distance between adjacent conductor sets, physical breaks between adjacent conductor sets, intermittent contact of the shielding films to each other directly either longitudinally, transversely, or both, and conductive adhesive, to name a few.

In FIG. 11 a shielded electrical cable 1102 is shown in cross section that includes two conductor sets 1104*a*, 104*b* spaced apart across a width of the cable 102 and extending longitudinally along a length of the cable. Each conductor set 1104*a*, 1104*b* has two insulated conductors 1106*a*, 1106*b* separated by gaps 1144. Two shielding films 1108 are disposed on opposite sides of the cable 1102. In transverse cross section, cover portions 1107 of the shielding films 1108 substantially surround conductor sets 1104*a*, 1104*b* in cover regions 1114 of the cable 1102. In pinched regions 1118 of the cable, on both sides of the conductor sets 1104*a*, 1104*b*, the shielding films 1108 include pinched portions 1109. In shielded electrical cable 1102, the pinched portions 1109 of shielding films 1108 and insulated conductors 1106 are arranged generally in a single plane when the cable 1102 is in a planar and/or unfolded arrangement. Pinched portions 1109 positioned in between conductor sets 1104*a*, 1104*b* are configured to electrically isolate conductor sets 1104*a*, 1104*b* from each other. When arranged in a generally planar, unfolded arrangement, as illustrated in FIG. 11, the high frequency electrical isolation of the first insulated conductor 1106*a* in the conductor set 1104*a* relative to the second insulated conductor 1106*b* in the conductor set 1104*a* is substantially less than the high frequency electrical isolation of the first conductor set 1104*a* relative to the second conductor set 1104*b*.

As illustrated in the cross section of FIG. 11, the cable 1102 can be characterized by a maximum separation, D, between the cover portions 1107 of the shielding films 1108, a minimum separation, d2, between the cover portions 1107 of the shielding films 1108, and a minimum separation, d1, between the pinched portions 1109 of the shielding films 1108. In some embodiments, d1/D is less than 0.25, or less than 0.1. In some embodiments, d2/D is greater than 0.33.

An optional adhesive layer may be included as shown between the pinched portions 1109 of the shielding films 1108. The adhesive layer may be continuous or discontinuous. In some embodiments, the adhesive layer may extend fully or partially in the cover region 1114 of the cable 1102, e.g., between the cover portion 1107 of the shielding films 1108 and the insulated conductors 1106*a*, 1106*b*. The adhesive layer may be disposed on the cover portion 1107 of the shielding film 1108 and may extend fully or partially from the pinched portion 1109 of the shielding film 1108 on one side of a conductor set 1104*a*, 1104*b* to the pinched portion 1109 of the shielding film 1108 on the other side of the conductor set 1104*a*, 1104*b*.

The shielding films 1108 can be characterized by a radius of curvature, R, across a width of the cable 1102 and/or by a radius of curvature, r1, of the transition portion 1112 of the shielding film and/or by a radius of curvature, r2, of the concentric portion 1111 of the shielding film.

In the transition region 1136, the transition portion 1112 of the shielding film 1108 can be arranged to provide a gradual transition between the concentric portion 1111 of the shielding film 1108 and the pinched portion 1109 of the shielding film 1108. The transition portion 1112 of the shielding film 1108 extends from a first transition point 1121, which is the inflection point of the shielding film 1108 and marks the end of the concentric portion 1111, to a second transition point 1122 where the separation between the shielding films exceeds the minimum separation, d1, of the pinched portions 1109 by a predetermined factor.

In some embodiments, the cable 1102 includes at least one shielding film that has a radius of curvature, R, across the width of the cable that is at least about 50 micrometers and/or the minimum radius of curvature, r1, of the transition portion 1112 of the shielding film 1102 is at least about 50 micrometers. In some embodiments, the ratio of the minimum radius of curvature of the concentric portion to the minimum radius of curvature of the transition portion, r2/r1, is in a range of 2 to 15.

In some embodiments, the radius of curvature, R, of the shielding film across the width of the cable is at least about 50 micrometers and/or the minimum radius of curvature in the transition portion of the shielding film is at least 50 micrometers.

In some cases, the pinched regions of any of the described shielded cables can be configured to be laterally bent at an angle $\alpha$ of at least 30°, for example. This lateral flexibility of the pinched regions can enable the shielded cable to be folded in any suitable configuration, such as, e.g., a configuration that can be used in a round cable. In some cases, the lateral flexibility of the pinched regions is enabled by shielding films that include two or more relatively thin individual layers. To warrant the integrity of these individual layers in particular under bending conditions, it is preferred that the bonds between them remain intact. The pinched regions may for example have a minimum thickness of less than about 0.13 mm, and the bond strength between individual layers may be at least 17.86 g/mm (1 lbs/inch) after thermal exposures during processing or use.

It may be beneficial to the electrical performance of any of the disclosed shielded electrical cables for the pinched regions of the cable to have approximately the same size and shape on both sides of a given conductor set. Any dimensional changes or imbalances may produce imbalances in capacitance and inductance along the length of the pinched region. This in turn may cause impedance differences along the length of the pinched region and impedance imbalances between adjacent conductor sets. At least for these reasons, control of the spacing between the shielding films may be desired. In some cases, the pinched portions of the shielding films in the pinched regions of the cable on both sides of a conductor set may be spaced apart within about 0.05 mm of each other.

Figure 12:
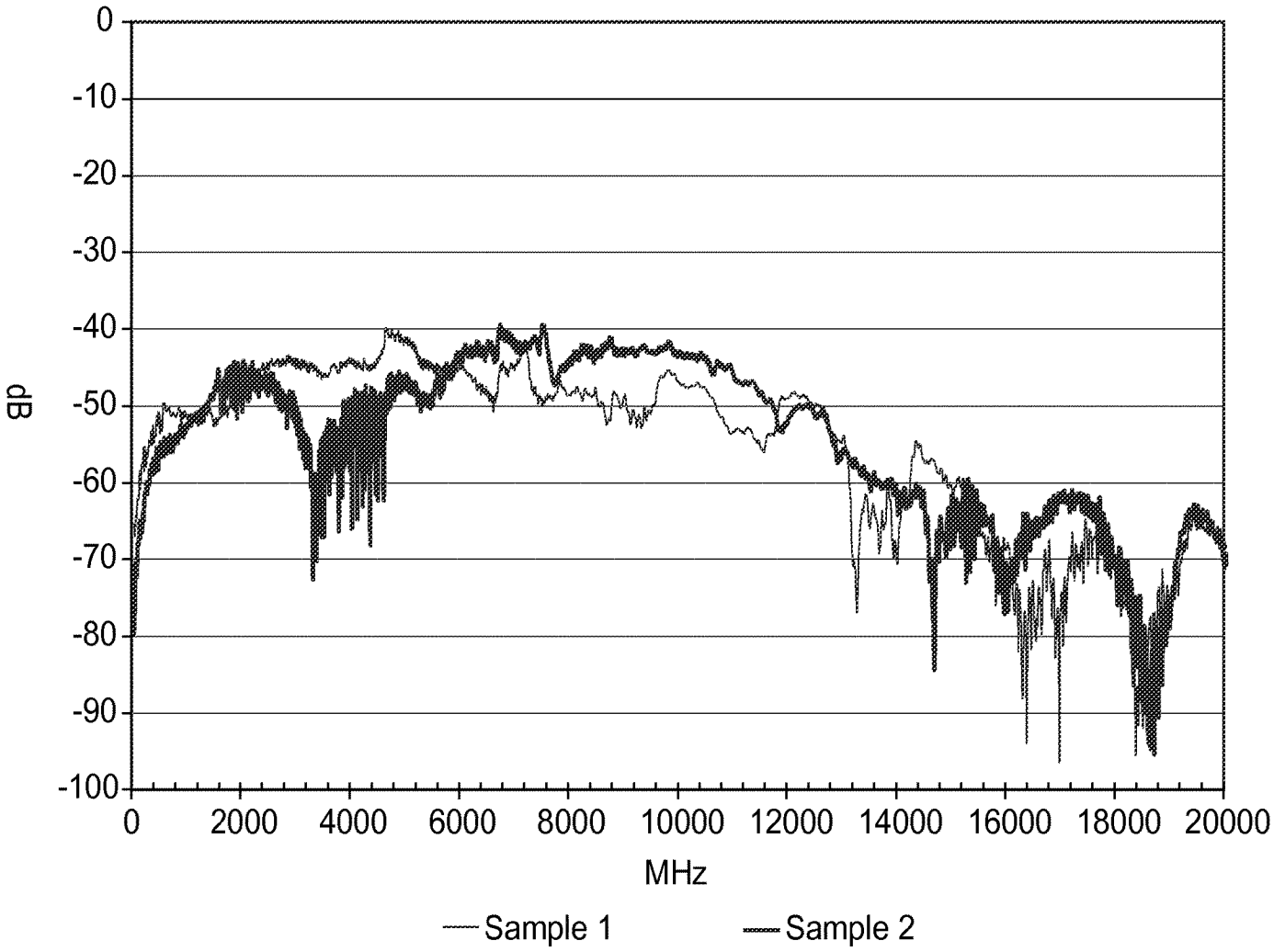
FIG. 12 is a graph comparing the electrical isolation performance of an exemplary shielded electrical cable to that of a conventional electrical cable.

In FIG. 12, the far end crosstalk (FEXT) isolation between two adjacent conductor sets of a conventional electrical cable is shown, wherein the conductor sets are completely isolated, i.e., have no common ground (Sample 1), and between two adjacent conductor sets of the shielded electrical cable 1102 illustrated in FIG. 11 wherein the shielding films 1108 are spaced apart by about 0.025 mm (Sample 2), both having a cable length of about 3 meters. The test method for creating this data is well known in the art. The data was generated using an Agilent 8720ES 50 MHz-20 GHz S-Parameter Network Analyzer. It can be seen by comparing the far end crosstalk plots that the conventional electrical cable and the shielded electrical cable 1102 provide a similar far end crosstalk performance. Specifically, it is generally accepted that a far end crosstalk of less than about −35 dB is suitable for most applications. It can be easily seen from FIG. 12 that for the configuration tested, both the conventional electrical cable and shielded electrical cable 1102 provide satisfactory electrical isolation performance. The satisfactory electrical isolation performance in combination with the increased strength of the pinched portion due to the ability to space apart the shielding films is an advantage of at least some of the disclosed shielded electrical cables over conventional electrical cables.

Figure 13:
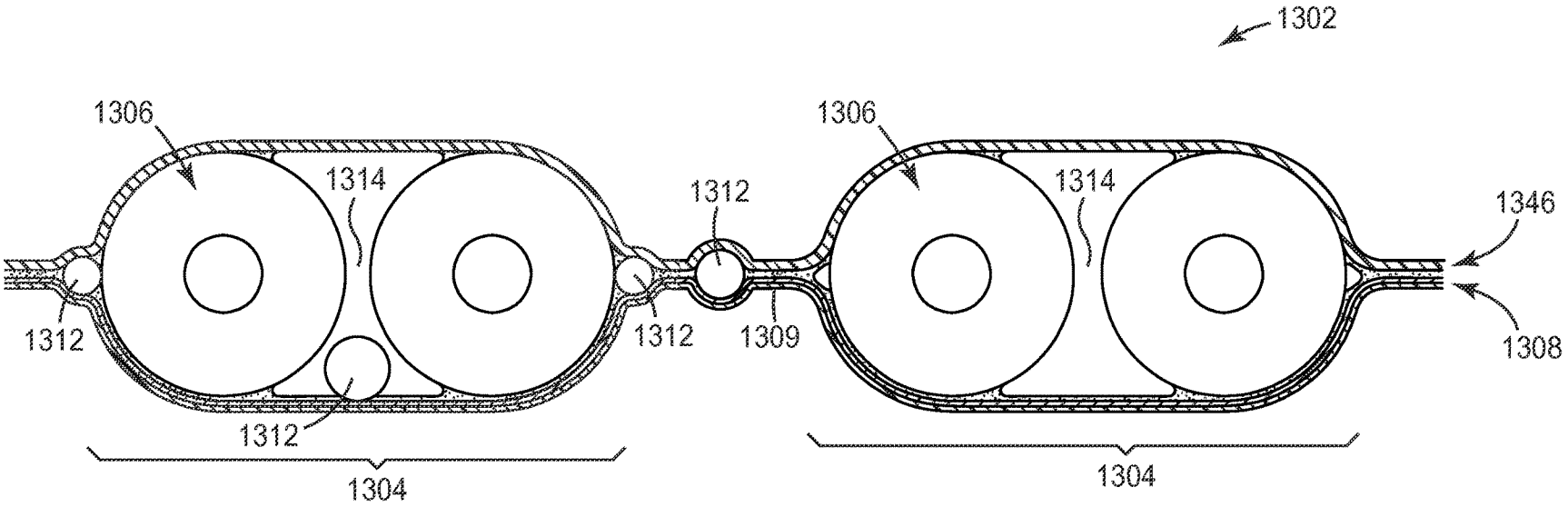
FIG. 13 is a front cross-sectional view of another exemplary shielded electrical cable.

In exemplary embodiments described above, the shielded electrical cable includes two shielding films disposed on opposite sides of the cable such that, in transverse cross section, cover portions of the shielding films in combination substantially surround a given conductor set, and surround each of the spaced apart conductor sets individually. In some embodiments, however, the shielded electrical cable may contain only one shielding film, which is disposed on only one side of the cable. Advantages of including only a single shielding film in the shielded cable, compared to shielded cables having two shielding films, include a decrease in material cost and an increase in mechanical flexibility, manufacturability, and ease of stripping and termination. A single shielding film may provide an acceptable level of electromagnetic interference (EMI) isolation for a given application, and may reduce the proximity effect thereby decreasing signal attenuation. FIG. 13 illustrates one example of such a shielded electrical cable that includes only one shielding film.

In FIG. 13 a shielded electrical cable 1302 is shown having only one shielding film 1308. Insulated conductors 1306 are arranged into two conductor sets 1304, each having only one pair of insulated conductors separated by dielectric/gaps 1314, although conductor sets having other numbers of insulated conductors as discussed herein are also contemplated. Shielded electrical cable 1302 is shown to include ground conductors 1312 in various exemplary locations, but any or all of them may be omitted if desired, or additional ground conductors can be included. The ground conductors 1312 extend in substantially the same direction as insulated conductors 1306 of conductor sets 1304 and are positioned between shielding film 1308 and a carrier film 1346 which does not function as a shielding film. One ground conductor 1312 is included in a pinched portion 1309 of shielding film 1308, and three ground conductors 1312 are included in one of the conductor sets 1304. One of these three ground conductors 1312 is positioned between insulated conductors 1306 and shielding film 1308, and two of the three ground conductors 1312 are arranged to be generally co-planar with the insulated conductors 1306 of the conductor set.

In addition to signal wires, drain wires, and ground wires, any of the disclosed cables can also include one or more individual wires, which are typically insulated, for any purpose defined by a user. These additional wires, which may for example be adequate for power transmission or low speed communications (e.g. less than 1 MHz) but not for high speed communications (e.g. greater than 1 Gb/sec), can be referred to collectively as a sideband. Sideband wires may be used to transmit power signals, reference signals or any other signal of interest. The wires in a sideband are typically not in direct or indirect electrical contact with each other, but in at least some cases they may not be shielded from each other. A sideband can include any number of wires such as 2 or more, or 3 or more, or 5 or more.

Further information relating to exemplary shielded electrical cables can be found in U.S. Patent Application Ser. No. 61/378,877, "Connector Arrangements for Shielded Electrical Cable", incorporated herein by reference.

Item 1 is an electrical ribbon cable, comprising:

at least one conductor set comprising at least two elongated conductors extending from end-to-end of the cable, wherein each of the conductors are encompassed along a length of the cable by respective first dielectrics;

a first and second film extending from end-to-end of the cable and disposed on opposite sides of the cable, wherein the conductors are fixably coupled to the first and second films such that a consistent spacing is maintained between the first dielectrics of the conductors of each conductor set along the length of the cable; and a second dielectric disposed within the spacing between the first dielectrics of the wires of each conductor set.

Item 2 is a cable according to item 1, wherein the second dielectric comprises an air gap that extends continuously along the length of the cable between closest points of proximity between the first dielectrics of the conductors of each conductor set.

Item 3 is a cable according to items 1 or 2, wherein the first and second films comprise first and second shielding films.

Item 4 is a cable according to item 3, wherein the first and second shielding films are arranged so that, in a transverse cross section of the cable, at least one conductor is only partially surrounded by a combination of the first and second shielding films.

Item 5 is a cable according to any of items 3 or 4, further comprising a drain wire disposed along the length of the cable and in electrical communication with at least one of the first and second shielding films.

Item 6 is a cable according to any of items 1-5, wherein at least one of the first and second films is conformably shaped to, in transverse cross section of the cable, partially surround each conductor set.

Item 7 is a cable according to item 6 wherein both the first and second films are in combination conformably shaped to, in transverse cross section of the cable, substantially surround each conductor set.

Item 8 is a cable according to items 6 or 7, wherein flattened portions of the first and second films are coupled together to form a flattened cable portion on each side of at least one conductor set.

Item 9 is a cable according to any of items 1-8, wherein the first dielectrics of the conductors are bonded to the first and second films.

Item 10 is a cable according to item 9, wherein at least one of the first and second films comprises:

a rigid dielectric layer;

a shielding film fixably coupled to the rigid dielectric layer; and a deformable dielectric adhesive layer that bonds the first dielectrics of the conductors to the rigid dielectric layer.

Item 11 is a cable according to any of items 1-10, further comprising one or more insulating supports fixably coupled between the first and second films along the length of the cable.

Item 12 is a cable according to item 11, wherein at least one of the insulating supports is disposed between two adjacent conductor sets.

Item 13 is a cable according to items 11 or 12, wherein at least one of the insulating supports is disposed between the conductor set and a longitudinal edge of the cable.

Item 14 is a cable of any of items 1-13, wherein a dielectric constant of the first dielectrics is higher than a dielectric constant of the second dielectric.

Item 15 is the cable according to any of items 1-14, wherein the at least one conductor set is adapted for maximum data transmission rates of at least 1 Gb/s.

Item 16 is an electrical ribbon cable, comprising:

a plurality of conductor sets each comprising a differential pair of wires extending from end-to-end of the cable, wherein each of the wires are encompassed by respective dielectrics;

first and second shielding films extending from end-to-end of the cable and disposed on opposite sides of the cable, wherein the wires are bonded to the first and second films such that a consistently spaced air gap extends continuously along a length of the cable between closest points of proximity between the dielectrics of the wires of each differential pair; and wherein the first and second shielding films are conformably shaped to, in combination, substantially surround each conductor set in transverse cross section, and wherein flattened portions of the first and second shielding films are coupled together to form a flattened cable portion on each side of each of the conductor sets.

Item 17 is a cable according to item 16 wherein at least one of the first and second shielding films comprises:

a deformable dielectric adhesive layer bonded to the wires;

a rigid dielectric layer coupled to the deformable dielectric layer; and a shielding film coupled to the rigid dielectric layer.

Item 18 is a cable according to any of items 16-17, wherein at least one of the conductor sets is adapted for maximum data transmission rates of at least 1 Gb/s.

The foregoing description of the example embodiments has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather determined by the claims appended hereto.

What is claimed is:

1. An electrical ribbon cable, comprising:

a conductor set comprising two elongated conductors extending from end-to-end of the cable, wherein the conductors are encompassed along a length of the cable by respective first dielectrics;

first and second flexible shielding films extending from end-to-end of the cable and disposed on opposite sides of the cable, a consistent spacing maintained between the first dielectrics of the conductors of the conductor set along the length of the cable, in transverse cross-section, the first and second shielding films forming cover portions of the shielding films substantially surrounding the conductor set and pinched regions of the shielding films on each side of the conductor set;

a second dielectric disposed between the first and second shielding films and extending between closest points of proximity between the first dielectrics of the conductors of the conductor set, a dielectric constant of the first dielectrics being different than a dielectric constant of the second dielectric, wherein a minimum separation between the cover portions of the first and second shielding films between the conductors is greater than a minimum separation between the pinched regions of the shielding films on each side of the conductor set; and a transition portion defined by the first and second shielding films and the conductor set and providing a gradual transition between the cover portions and the pinched regions of the first and second shielding films, wherein a ratio of a minimum radius of curvature of the first shielding film in the cover portion of the first shielding film to a minimum radius of curvature of the first shielding film in the transition portion of the first shielding film is in a range from 2 to 15.

2. A cable according to claim 1, wherein the second dielectric is air.

3. A cable according to claim 1, wherein the dielectric constant of the first dielectrics is greater than the dielectric constant of the second dielectric.

4. A cable according to claim 1, wherein the dielectric constant of the first dielectrics is smaller than the dielectric constant of the second dielectric.

5. A cable according to claim 1, wherein the first dielectrics of the conductors are adhesively bonded to the first and second shielding films.

6. A cable according to claim 1, wherein a maximum separation between the cover portions of the first and second shielding films is D, a minimum separation between the cover portions of the first and second shielding films between the conductors is d, d/D being greater than 0.33.

7. A cable according to claim 1 comprising a transition portion defined by the first and second shielding films and the conductor set and providing a gradual transition between the cover portions and the pinched regions of the first and second shielding films, wherein the transition portion has a lateral length that is less than diameters of the conductors in the conductor set.

8. A cable according to claim 1, wherein at least one of the first and second shielding films has a radius of curvature, R, across an entire width of the cable, R being at least about 50 micrometers.

* * * * *